US005248875A

United States Patent [19]

Douglas et al.

[11] Patent Number: 5,248,875

[45] Date of Patent: Sep. 28, 1993

[54] METHOD FOR INCREASED RESOLUTION IN TANDEM MASS SPECTROMETRY

[75] Inventors: Donald Douglas, Toronto; Bruce Thomson, Etobicoke; Jay Corr, Richmond Hill; James Hager, Milton, all of Canada

[73] Assignee: MDS Health Group Limited, Etobicoke, Canada

[21] Appl. No.: 873,149

[22] Filed: Apr. 24, 1992

[51] Int. Cl.[5] ..... H01J 49/26

[52] U.S. Cl. ..... 250/282; 250/281

[58] Field of Search ..... 250/282, 281, 288

[56] References Cited

U.S. PATENT DOCUMENTS

| | | | |
|---|---|---|---|
| 4,037,100 | 7/1977 | Durser | 250/282 |
| 4,137,750 | 2/1979 | French et al. | 250/281 |
| 4,328,420 | 5/1982 | French | 250/282 |
| 4,814,613 | 3/1989 | Fite et al. | 250/282 |
| 4,994,165 | 2/1991 | Lee et al. | 250/288 |

OTHER PUBLICATIONS

Paper entitled "High and Low Energy Collision Mass Spectrometry/Mass Spectrometry of Aza and Amino Polynuclear Aromatic Compounds in Coal-Derived Liquids", by Clupek et. al., published in *Analytical Chemistry*, 1982, 54, pp. 2215-2219.

Paper entitled "The Use of Triple Quadrupoles for Sequential Mass Spectrometry", by Dawson et. al., published in *Organic Mass Spectrometry*, vol. 17, No. 5, 1982, pp. 212-219.

Paper entitled "Mechanism of the Collision-Induced Dissociation of Polyatomic Ions Studies by Triple Quadrupole Mass Spectrometry", by D. J. Douglas, published in *The Journal of Physical Chemistry*, vol.. 86, No. 2, pp. 185-191.

Paper entitled "The Role of Kinetic Energy in Triple Quadrupole Collision Induced Dissociation (CID) Experiments", by B. Shushan et. al, published in *International Journal of Mass Spectrometry and Ion Physics*, vol. 46, 1983, pp. 71 and following.

Paper entitled "An Atmospheric-Pressure Ionization Mass Spectrometer/Mass Spectrometer", by Caldecourt et. al., *International Journal of Mass Spectrometry and Ion Physics*, vol. 49, 1983, pp. 233-251.

Paper entitled "A Hybrid BEQQ Mass Spectrometer", by A. E. Shoen et. al., published in *International Journal of Mass Spectrometry and Ion Processes*, 65 (1985), pp. 125-140.

Paper entitled "Performance of a Hybrid Mass Spectrometer", by J. D. Ciupek et. al., published in *International Journal of Mass Spectrometry and Ion Processes*, vol. 65, 1985, pp. 141-157.

Paper entitled "Tandem Mass Spectrometry of Peptides Using Hybrid and Four-Sector Instruments: A Comparative Study", by Mark F. Bean et. al., published in *Analytical Chemistry*, vol. 63, 1991, pp. 1473-1481.

Pp. 4-6 and 4-7 from manual published by Finnegan Corporation in the U.S. dated about Dec., 1990.

Pp. 15-19 from Finnegan Corporation manual for mass spectrometer instruments, precise date of publication unknown but before 1990.

(List continued on next page.)

*Primary Examiner*—Paul M. Dzierzynski
*Assistant Examiner*—Kiet T. Nguyen
*Attorney, Agent, or Firm*—Bereskin & Parr

[57] ABSTRACT

A method is provided of increasing the resolution in a tandem mass spectrometer having a first quadrupole Q1 to select a parent ion, a second quadrupole Q2 which contains a target gas and forms a collision cell, and a third or analyzing quadrupole Q3 which generates a mass spectrum from daughter ions from Q2. In the method, the target thickness of the target gas in Q2 is held at least at $1.32\times10^{15}$ $cm^{-2}$, preferably at least $3.30\times10^{15}$ $cm^{-2}$, and the DC offset voltage between Q2 and Q3 is kept low or zero. This greatly improves the resolution available in Q3. Q3 is therefore operated with at least unit resolution, and in some cases with resolution of ½ or ⅓ amu, making it possible to resolve isotopes of singly, doubly or triply charged daughter ions.

36 Claims, 19 Drawing Sheets

OTHER PUBLICATIONS

Paper entitled "Tandem-in-Space and Tandem-in-Time Mass Spectrometry: Triple Quadrupoles and Quadrupole Ion Traps", by Jodie V. Johnson et. al., published in *Analytical Chemistry,* vol. 62, 1990, pp. 2162-2172.

Excerpt from text published in 1990 entitled "Methods in Enzymology, vol. 193, Mass Spectrometry", containing chapter entitled Tandem Mass Spectrometry: Quadrupole and Hybrid Instruments, by Yost et. al.

Paper entitled "Oligopeptide Sequence Analysis by Collision-activated Dissociation of Multiply Charged Ions", by Hunt et. al., published in *Rapid Communications in Mass Spectrometry,* vol. 3, No. 4, 1989, pp. 122-124.

Paper entitled "High-resolution tandem mass spectrometry of large biomolecules", by Loo et. al., published in *Proc. National Academy of Science USA,* vol. 89, Jan. 1992, pp. 286-289.

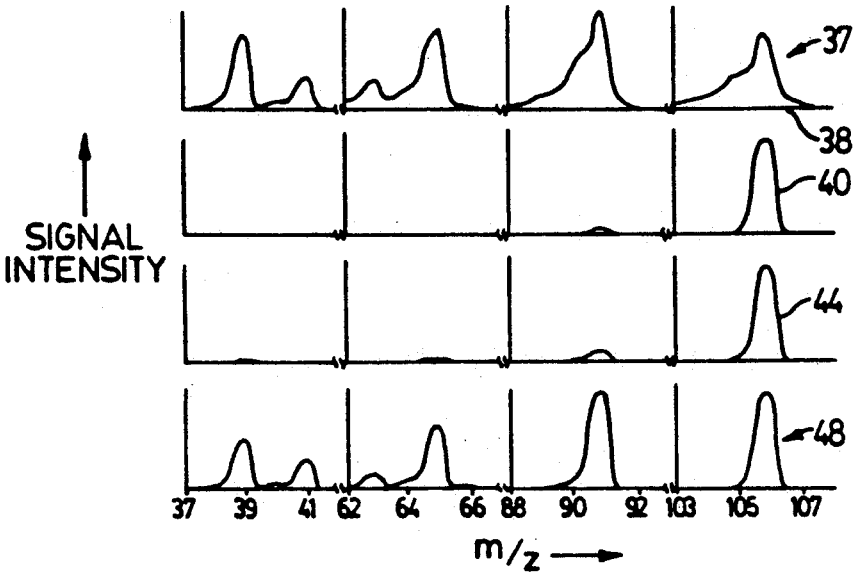
FIG. 3 (PRIOR ART)
FIG. 4 (PRIOR ART)
FIG. 5 (PRIOR ART)
FIG. 6 (PRIOR ART)
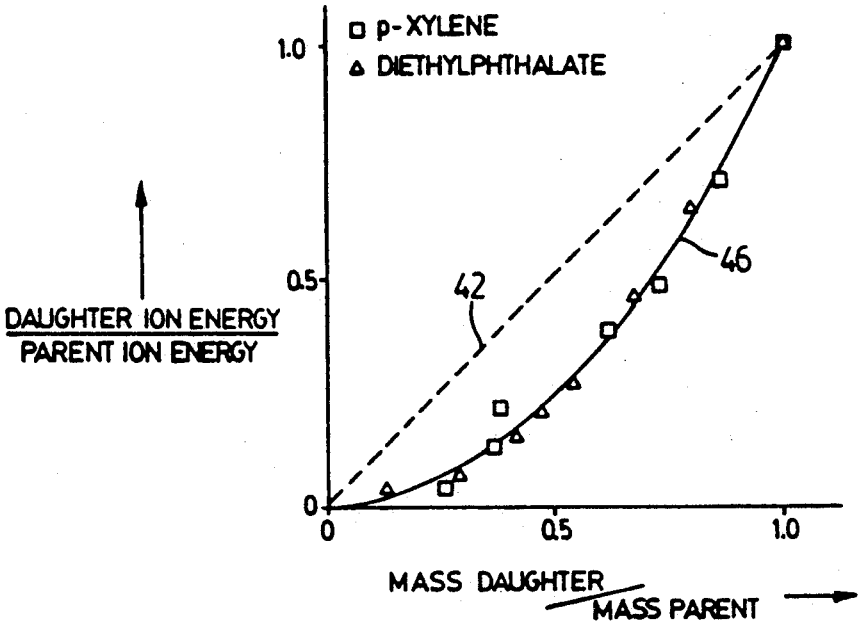
FIG. 7
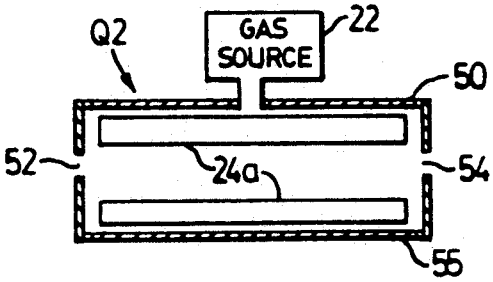
FIG. 8

SPECTRA ms/ms OF RENIN 880↔ 110 eV HIGH RESOLUTION 1.0 mTorr

METHOD FOR INCREASED RESOLUTION IN TANDEM MASS SPECTROMETRY

FIELD OF THE INVENTION

This invention relates to mass spectrometry, in which parent ions are generated and then fragmented by collisions to produce daughter ions. The daughter ions are then analyzed.

BACKGROUND OF THE INVENTION

It is common in mass spectrometry to use at least two mass spectrometers in series separated by a collision cell. In a triple quadrupole system the first mass spectrometer is a quadrupole operated in a mass resolving mode; the collision cell contains a quadrupole operated in the total ion mode, and the second mass spectrometer is a quadrupole operated in a mass resolving mode. These are commonly referred to as Q1, Q2 and Q3 respectively, and the process is often called MS/MS. In this process, ions are directed into the first mass spectrometer Q1, which selects a parent ion or ions of interest (i.e. a parent ion or ions having a given mass to charge (m/z) ratio). The selected parent ions are then directed into the collision cell Q2, which is commonly pressurized with gas. In the collision cell Q2 the parent ions are fragmented by collision induced dissociation, to produce a number of daughter ions. Alternatively, the parent ions may undergo reactions in the collision gas to form adducts or other reaction products. The term "daughter ion" is intended to mean any of the ion products of the collisions between the parent ions and the gas molecules in the collision cell.

The daughter ions (and remaining parent ions) from the collision cell Q2 then travel into the second mass spectrometer Q3, which is scanned to produce a mass spectrum, usually of the daughter ions.

As is well known, in scanning the second mass spectrometer Q3, the process is as follows Q3 is first set to allow ions in a particular m/z range to pass therethrough by adjusting the magnitude and ratio of the RF to DC voltages applied to the rods of Q3. (RF means radio frequency AC.) After a short time (e.g. 5 milliseconds), called the dwell time, the magnitude of these voltages is changed to a new setting which allows ions in a different (normally higher) m/z range to pass through Q3. Typically ten such settings may be used per atomic mass unit (amu). Thus, for example, the scan may take 50 milliseconds per amu or 50 seconds for a mass spectrum spanning 1,000 amu.

As is also well known, the resolution during the scan can be adjusted by setting the point at which the third mass spectrometer Q3 operates on its characteristic stability diagram (by setting the ratio of the RF and DC voltages on its rods). With a lower DC to RF ratio, the m/z range allowed to pass through Q3 at each setting is larger, resulting in a greater detected signal (i.e. higher sensitivity). However the resolution is usually lower, i.e. it may not be possible to distinguish between ions of closely adjacent mass to charge ratio. Conversely, if Q3 is set for a higher DC to RF ratio, meaning that only ions in a smaller m/z range can pass through Q3 at each setting, then while the resolution may be better, the detected signal or sensitivity is reduced. The smaller detected signal can be a serious problem.

A further problem in triple quadrupole MS/MS is that it is very difficult except under the most favourable conditions to distinguish in quadrupole Q3 between daughter ions whose m/z differs by only one m/z unit. In addition, so far as is known, it has not been possible to distinguish in quadrupole Q3 between daughter ions whose m/z differ by less than one m/z unit. The lack of adequate resolution has long been a problem, since it creates difficulty in interpreting the mass spectra. The difficulty increases when some of the ions are multiply charged, as is common for ions from organic molecules such as peptides and proteins.

BRIEF SUMMARY OF THE INVENTION

Accordingly, it is an object of the invention to provide a method for achieving increased resolution in MS/MS. In one of its aspects the invention provides, in a method of analyzing ions, in which parent ions are directed into a collision cell containing a target gas and collide in said collision cell with said target gas to produce daughter ions from said parent ions, and in which said daughter ions are then directed into an analyzing mass spectrometer and analyzed by producing a mass spectrum thereof, and in which there is a DC circuit between said collision cell and said analyzing mass spectrometer, the improvement comprising maintaining the target thickness of said target gas in said collision cell at least at substantially $1.32\times10^{15}$ $cm^{-2}$, maintaining a substantially constant DC voltage across said DC circuit during the production of at least a substantial portion of said mass spectrum, operating said analyzing mass spectrometer at a resolution at least equal to one m/z unit throughout said substantial portion of said mass spectrum, and producing said mass spectrum having a resolution of at least one m/z unit in at least said substantial portion.

Further objects and advantages of the invention will appear from the following description, taken together with the accompanying drawings.

BRIEF DESCRIPTION OF THE DRAWINGS

FIGS. 3 to 6 are mass spectra showing the effects of varying the DC rod offset voltage of spectrometer Q3;

FIG. 7 is a graph showing the ratio of daughter ion energy to parent ion energy versus the ratio of daughter ion mass to parent ion mass;

FIG. 8 is a diagrammatic view showing a collision cell arranged to contain a higher pressure collision gas;

DETAILED DESCRIPTION OF PREFERRED EMBODIMENTS

Figure 1:
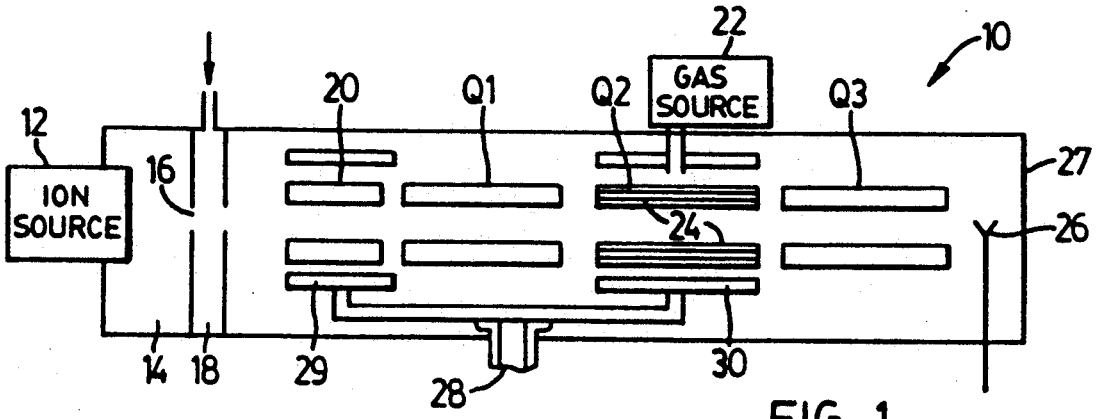
FIG. 1 (PRIOR ART)
FIG. 1 is a diagrammatic view of a prior art triple quadrupole mass spectrometer.

Reference is first made to FIG. 1, which shows diagrammatically a known triple quadrupole mass spectrometer 10 commercially sold by Sciex Division of MDS Health Group Limited, of Thornhill, Ontario, Canada under its trade mark API III. The mass spectrometer 10 has a conventional ion source 12 which produces ions in an inlet chamber 14. The ions in chamber 14 are directed through an orifice 16, a gas curtain chamber 18 (as shown in U.S. Pat. No. 4,137,750 issued Feb. 6, 1979), a set of RF-only focusing rods 20, and then through first, second and third quadrupoles Q1, Q2 and Q3 respectively. As is conventional, Q1 and Q3 have both RF and DC applied between their pairs of rods and act as mass filters. Q2 is of open structure (formed from wires) and has RF only applied to its rods.

In first quadrupole Q1 desired parent ions are selected, by setting an appropriate magnitude and ratio of RF to DC on its rods. In second quadrupole Q2, gas from source 22 is sprayed across the rods 24 of quadrupole Q2 to create a collision cell in which the parent ions entering Q2 are fragmented by collision with the added gas. Q3 serves as a mass analyzing device and is scanned to produce the desired mass spectrum. Ions which pass through Q3 are detected at detector 26. The ions impinging upon detector 26 are used to construct a mass spectrum, as is well known.

The quadrupoles Q1, Q2, Q3 and the RF-only rods 20 are housed in a chamber 27 which is evacuated by a cryopump 28 having a cryosurface 29 encircling rods 20 and another cryosurface 30 encircling Q2. It is noted that while FIG. 1 illustrates a typical presently available commercial instrument which is competitive with other available triple quadrupole mass spectrometers, the details of construction can of course vary. For example conventional vacuum pumps can be used instead of cryopumps.

Figure 2:
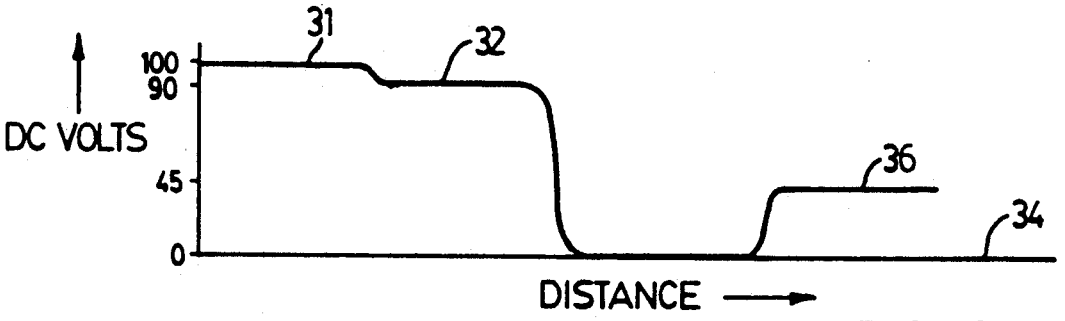
FIG. 2 (PRIOR ART)
FIG. 2 is a view of bias voltages applied to parts of the mass spectrometer of FIG. 1.

Reference is next made to FIG. 2, which shows DC voltages plotted against position along the quadrupoles Q1, Q2, Q3 of FIG. 1. In FIG. 2 it is assumed that the RF-only rods 20 (often called Q0) are biased at 100 volts as shown at 31, that Q1 is biased at 90 volts as shown at 32, and that 100 volts of collision energy are desired (to fragment parent ions adequately in Q2), so that Q2 is held at ground (i.e. no DC bias) as shown at 34. The energies $E_d$ of daughter ions formed in Q2 are approximately related to the energy $E_p$ of the parent ions by the equation $$E_d=(m_d/m_p)E_p \quad \ldots (1)$$

where $m_d$ is the mass of the daughter ion and $m_p$ is the mass of the parent ion. Assuming a singly charged parent ion of 1,000 amu and a daughter ion of 450 amu, if Q3 had no DC offset, the parent ion would pass through it with a kinetic energy of 100 electron volts (eV) and the daughter ion with kinetic energy of approximately 45eV, which is far too much for good resolution in Q3. Therefore, normally, a DC offset voltage 36 is applied to the rods of Q3 to prevent this. As is known, the DC offset voltage is a voltage which is applied between all of the rods of Q3 and ground (as contrasted with the DC operating voltage, which is applied between one pair of rods of Q3 and the other pair to make Q3 act as a mass filter).

Figure 2A:
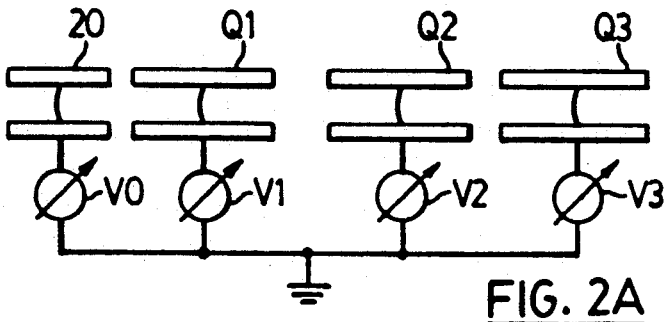
FIG. 2A (PRIOR ART)
FIG. 2A is a block diagram showing how the bias voltages of FIG. 2 are applied.

As shown in FIG. 2A, the DC bias or offset voltages for the quadrupole rods are typically supplied by DC sources V0, V1, V2, V3 respectively, which are part of the power supplies (not shown) for the mass spectrometer 10, and which are referenced to ground.

In FIG. 2, by way of example, offset voltage 36 (i.e. the DC potential difference between Q2 and Q3) is shown as being 45 volts. One problem with this is that ions from Q2 having energies less than 45eV (i.e. singly charged ions of mass less than about 450 amu) will not be able to surmount the 45 volt potential hill in Q3 and will not reach the detector 26.

To solve this problem and to produce better spectra, it has become common to ramp the DC offset voltage on Q3, i.e. to vary it with mass, as the spectrum is produced. The results of this are shown in FIGS. 3 to 6, which show portions of four daughter ion mass spectra for p-xylene obtained by scanning the DC rod offset 36 of Q3 with the mass of ions passing through Q3. The parent ion energy was 66eV in Q2. The spectra shown in FIGS. 3 to 6 were published in an article entitled "The Role of Kinetic Energy in Triple Quadrupole Collision Induced Dissociation (CID) Experiments" by Shushan, Douglas, Davidson & Nacson (*International Journal of Mass Spectrometry and Ion Physics*, Volume 46, page 71, 1983). In FIG. 3, the rod offset voltage 36 was zero (no potential difference between Q2 and Q3), and while the daughter ion intensities were good (i.e. the detected signal was quite large), the resolution became progressively worse as the mass increased. This can be seen from the very broad peaks of curve 37 in FIG. 3, and the fact that the signal barely reaches the baseline 38.

In FIG. 4 the DC offset voltage 36 on Q3 was held constant at 55 volts While this provided good resolution and sensitivity for the parent ion as indicated at 40, few of the daughter ions were able to get past the "potential hill" on Q3 and nearly all the daughter ion intensity was lost.

In FIG. 5 the DC offset voltage on Q3 was ramped linearly with mass as indicated by line 42 in FIG. 7 and suggested by equation (1). In FIG. 7 the ratio mass of daughter ions/mass parent ions is plotted on the horizontal axis; and the ratio of daughter ion energy to parent ion energy ($E_d/E_p$) is plotted on the vertical axis. It will be seen from FIG. 5 that while good resolution and sensitivity for the parent ion were achieved as indicated at 44, again most of the daughter ion intensity was lost. This is because the actual daughter ion energies, as shown by curve 46 in FIG. 7, are less than those predicted by equation (1), so the daughter ions cannot climb the potential hill in Q3, i.e. the potential hill given by line 42 is generally greater than the nominal daughter ion energies.

In FIG. 6 the rod offset voltage 36 on Q3 was scanned proportionally to the measured energy of the fragments, as indicated by curve 46 in FIG. 7. This preserved resolution and intensity throughout the mass range, as indicated by mass spectrum 48 in FIG. 6.

Because of the results observed from FIGS. 3 to 7, it has been common practice for some years for workers using MS/MS to ramp the rod offset voltage of Q3 in a manner proportional to the energy of the daughter ions. However since the energy of the daughter ions is not normally well known (because equation (1) is not accurate), knowing how to properly ramp the offset voltage in Q3 has always presented a difficult and time consuming problem.

In addition, as the mass of the parent ion increases, it becomes more difficult, even with ramping the DC offset on Q3, to achieve good resolution. Typically, when the parent ion is heavier than 200 atomic mass units, good resolution in Q3 for daughter ions across the full spectrum becomes extremely difficult to achieve. It becomes nearly impossible to achieve when the parent ion is heavier than 400 amu.

The inventors have now discovered a different approach to obtaining good resolution while retaining adequate intensity, and one which does not require ramping the DC offset voltage on Q3. With the approach of the invention, the DC offset voltage on Q3 can remain fixed. The invention finds its major applications when the mass of all or most of the parent ions being studied exceeds at least 200 amu, and usually when such mass exceeds 400 amu.

Specifically, the inventors have discovered that resolution can be increased by increasing the pressure in the collision cell constituted by collision cell Q2, i.e. by increasing the "target thickness" in Q2. As is known, the target thickness is defined as the number density of the gas in the collision cell Q2 multiplied by the length of the collision cell. For a given length collision cell the target thickness is increased by increasing the pressure of the collision gas in the cell. It had previously been thought, by the inventors and others, that increasing the pressure in the collision cell constituted by Q2 would cause unacceptable losses in ion intensities, because the energies of ions directed into the collision cell Q2 are so high that it was expected that fragments or daughter ions would scatter out of the space between the rods in Q2. (Typically the collision energy in Q2 is between 30 and 200 electron volts.)

However the inventors have now found that increasing the pressure in Q2 does not in fact cause a substantial loss of ions. It has been found that increasing the pressure in Q2 decreases the energy, and consequently the energy spread, of ions leaving Q2 and that this, and possibly other factors which are not presently fully understood but which result from the increased pressure in Q2, permit greatly improved resolution in Q3, and without any need to scan the rod offset for Q3.

The pressure in collision cell Q2 may be increased by any conventional means. For example, as shown in FIG. 8, the rods 24*a* (which can be solid) of Q2 can be housed in a shell or "can" 50 having entrance and exit apertures 52, 54 and a cylindrical body 55. Apertures 52, 54 are electrically isolated from each other and from the body 55. The pressure in shell 50 may be controlled by changing the size of apertures 52, 54; the smaller these apertures are made, the higher will be the pressure in shell 50 for a given gas flow from source 22. Of course apertures 52, 54 cannot be made too small since they must transmit the ion signal. The pressure can also be controlled by adjusting the amount of gas supplied from source 22. However the amount of gas used should preferably be minimized, consistent with obtaining the necessary higher pressure, since too much gas will load the vacuum pump used to evacuate the chamber 27 in which the mass spectrometers Q1 and Q3 are located, causing the pressure to rise in Q1 and Q3.

In addition, the target thickness can be increased by increasing the length of shell 50 while maintaining the pressure in it constant. Since the energy of ions exiting shell 50 at aperture 54 is determined largely by the number of collisions which the ions incur, increasing the length of shell 50 will increase the number of collisions. In the examples which follow, shell 50 had a length of 20 cm and the collision gas was argon. (Other collision gases, e.g. nitrogen, or mixtures of gases, may also be used.) The collision energy referred to below is the laboratory collision energy, rather than the center of mass collision energy.

Figure 9:
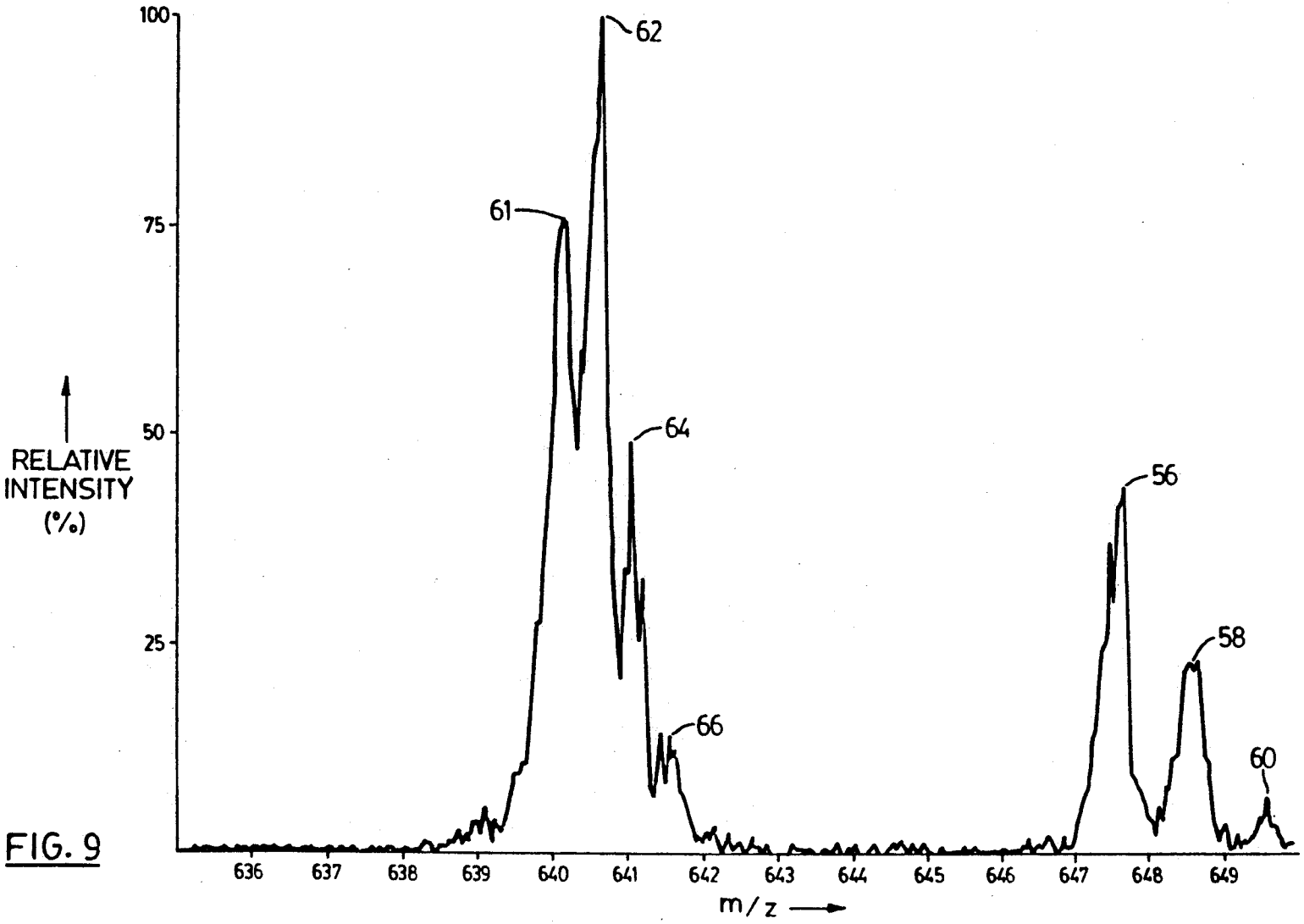
FIGS. 9 to 17 are mass spectra showing the effects of the invention.

Reference is next made to FIG. 9, which shows a mass spectrum obtained for the substance porcine renin substrate tetradecapeptide (Angiotensinogen 1–14), hereafter called renin substrate. The concentration of renin substrate was $2.0\times10^{-5}$ M (moles per liter). Renin substrate has a formula weight of 1757.0 amu, and FIG. 9 shows the mass spectrum for daughters of doubly protonated renin substrate ($M+2H^+$, $m/z\approx880$) in a m/z range 635 to 650. In FIG. 9 and in all other spectra shown, the horizontal axis shows mass to charge ratio (m/z), where the mass is in atomic mass units and z is the number of electronic charges on the ion. The vertical axis shows relative intensity, the largest peak being 100%. FIG. 9 was constructed from 100 scans each in steps of 0.1 m/z units, with 10 milliseconds dwell time at each step. The pressure used in shell 50 of collision cell Q2 was 5 millitorr (1 millitorr=0.133 Pascals), and the potential difference between RF-only rods 20, i.e. Q0, and Q2 was 30 volts. Because the parent ions of the renin substrate were doubly charged, the collision energy was 60eV. The rod offset voltage on Q3 was fixed equal to that on Q2, so that there was no potential hill to climb for ions entering Q3. It appears, as will be seen from the results, that no potential hill was needed to slow down ions entering Q3, since the kinetic energies of ions entering Q3 had already been greatly reduced by collisions in Q2.

It will be seen that FIG. 9 contains three peaks 56, 58 and 60. Peak 56 denotes a daughter of renin substrate at about m/z 647.6. (The actual mass to charge ratios may differ slightly from those observed, depending on the calibration of Q3.) Peak 58 represents the same daughter of renin substrate at about m/z 648.6. This second daughter has one of its carbon-12 atoms replaced by a carbon-13 atom, so that its mass is 1 amu higher than that indicated at peak 56. Similarly, peak 60 represents the same daughter of renin substrate as that represented by peak 56, but at about m/z 649.6, i.e. 2 amu higher than peak 56. This is because the daughter at peak 60 has two of its carbon-12 atoms replaced by carbon-13 atoms. The higher mass isotope peaks also contain contributions from $^{17}O$, $^{15}N$, and $^{2}H$ atoms. Thus, the method has been able to resolve the base ion and two isotopes of the daughter in question, an unusual achievement.

It will also be seen that FIG. 9 includes four peaks 61, 62, 64, 66, at about m/z 640.0, 640.5, 641.0 and 641.5 respectively. These peaks represent doubly charged daughters of renin substrate. Again, peak 61 represents doubly charged daughters with only carbon-12 atoms; peak 62 indicates daughters with one C-13 atom, peak 64 indicates daughters with two C-13 atoms, and peak 66 represents daughters with three C-13 atoms. The higher mass isotopic peaks again contain contributions from $^{17}O$, $^{15}N$ and $^{2}H$ atoms. Peaks 61, 62, 64, 66 are only 0.5 m/z units apart, but they have been resolved by the method of the invention, a remarkable achievement and one which, so far as is known, has never before been achieved by triple quadrupole MS/MS.

Figure 10:
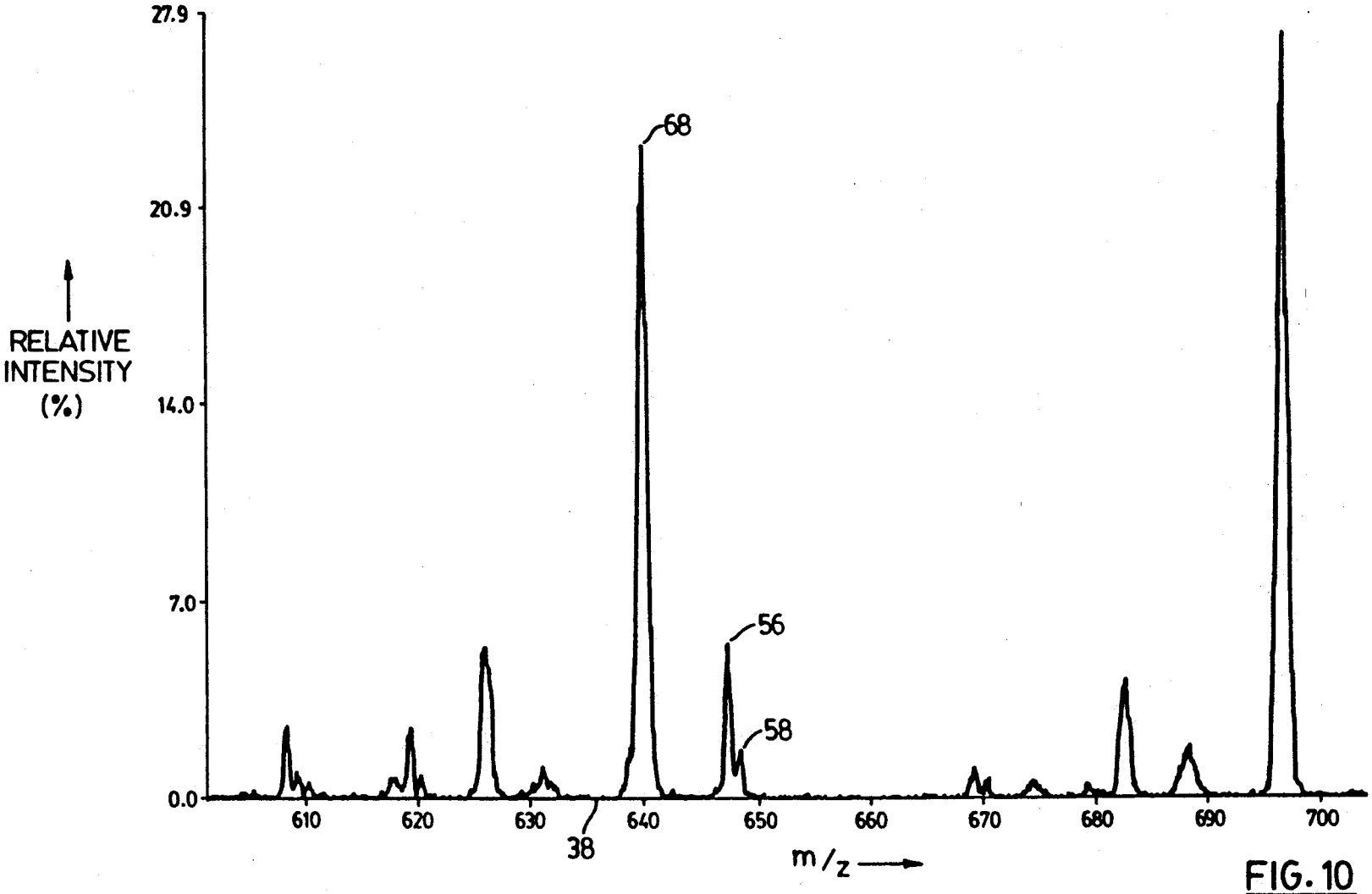

FIG. 9 was produced with Q3 adjusted for high resolution. (As will be discussed in more detail, the resolution is adjusted in conventional manner by setting the ratio of RF and DC voltages applied between the pairs of rods of Q3 to operate Q3 at a desired point in its stability diagram.) Reference is next made to FIG. 10, which shows a similar scan for renin substrate, but with Q3 set for "unit" resolution, i.e. only to resolve ions which are 1.0 unit apart on the m/z scale (one atomic mass unit for singly charged ions). Q3 was not set to resolve ions closer than 1.0 m/z unit. In FIG. 10 the scan was from m/z 600 to m/z 704, again using 5.0 millitorr in Q2 and the same bias or offset voltages. It will be seen from FIG. 10 that the two peaks 56, 58 at about m/z 647.6 and 648.6 are resolved, but that the third isotope at peak 60 was not seen to be resolved due to the limited signal to noise ratio. In addition, only one peak 68 appears at about m/z 640, in place of former separately resolved peaks 61, 62, 64, 66. Thus, in FIG. 10 one isotope of the singly charged fragments was resolved, but the isotopes of the doubly charged fragments were not resolved. However the resolution in FIG. 10 was still quite good, as can be seen from the sharpness of the peaks and the excursions of the signal to the base line 38 between the peaks.

Figure 11:
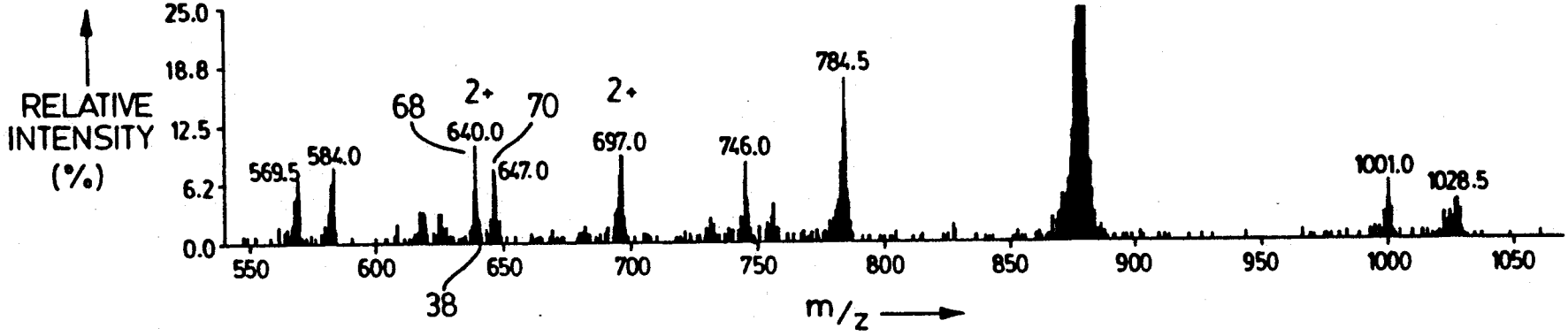

Reference is next made to FIG. 11, which shows a portion of a typical mass spectrum for renin substrate as produced by the commercial API III instrument discussed previously. The solution concentration was $2.0\times10^{-5}$M, as used previously. Here, the peak 68 at about m/z 640 (doubly charged) and a peak 70 representing daughter ions at about m/z 647 (singly charged) were barely resolved, and the signal only briefly reaches the base line 38 between these two peaks. No isotopes at all were resolved. The sensitivity on peak 68 was about 1,000 ions per second.

Figure 12:
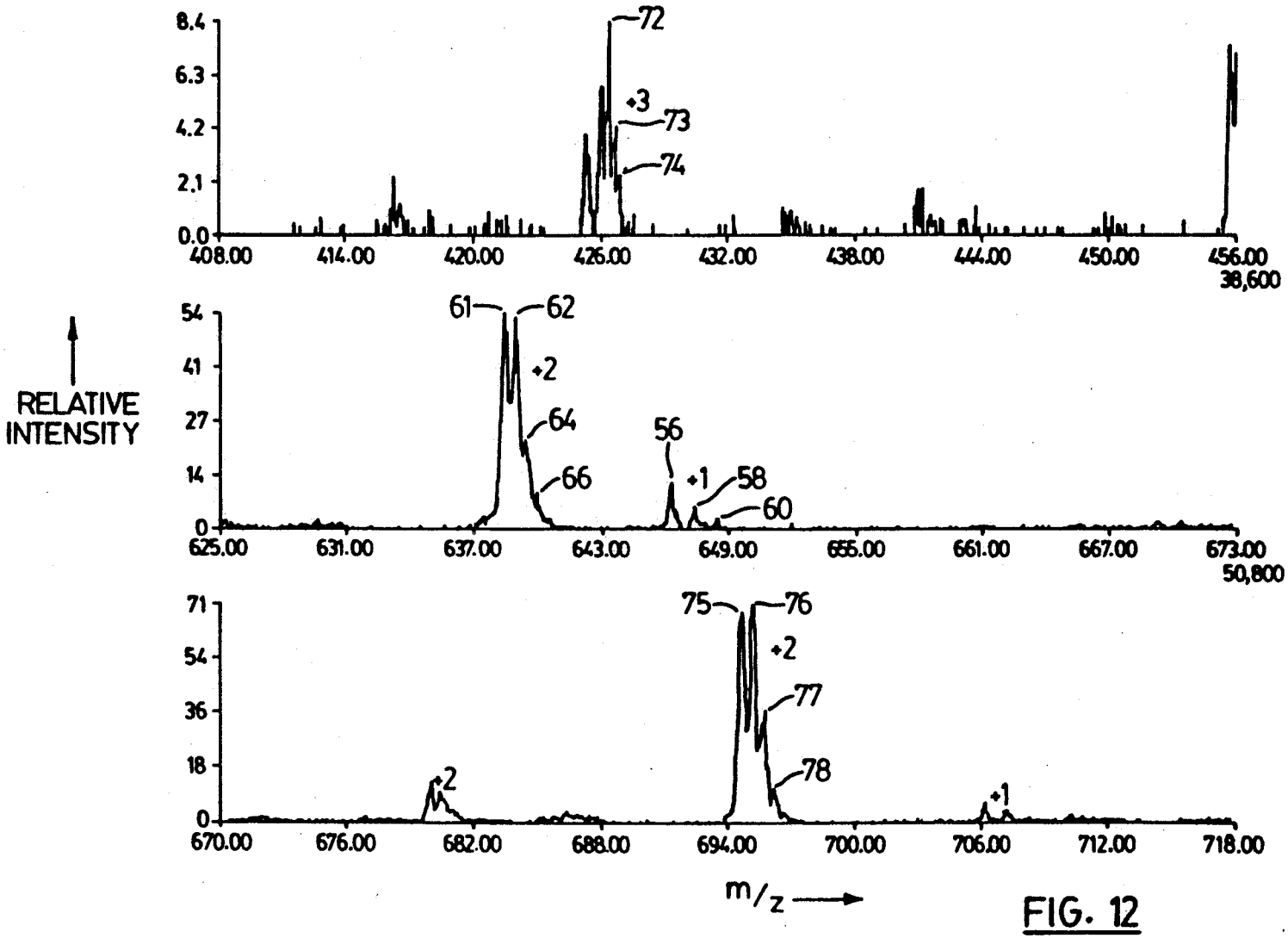

Reference is next made to FIG. 12, which shows three portions of a mass spectrum for renin substrate, from m/z 408 to 456, 625 to 673, and 670 to 718. The parent ion in this case was triply protonated renin substrate ($M+3H^+$, m/z$\approx$587). The difference in potential between Q0 and Q2 was 20 volts, giving 60eV parent ion energy. The FIG. 12 spectrum was produced from ten scans at a high resolution setting. Relative intensities of the detected signal are shown on the vertical axis (the relative intensity of the highest peak, not shown, being 100%). Again the rod offset of Q3 was set equal to that of Q2. Singly, doubly and triply charged ions are indicated by +1, +2 and +3 respectively.

It will be seen in FIG. 12 that the same peaks 56, 58, 60 appear as in FIG. 9, resolving the daughters at about m/z 647.6, 648.6 and 649.6. In addition, in FIG. 12 the four peaks 61, 62, 64, 66 for the doubly charged ions (which peaks are ½ m/z unit apart) are also resolved. Further, the doubly charged peaks 75, 76, 77, 78 at just above m/z 694 are also resolved.

In FIG. 12, it will also be seen that peaks 72, 73, 74 at just over m/z 426 are also resolved. The fragment or daughter ions indicated by these peaks are triply charged, so that peaks 72, 73, 74 are only ⅓ m/z unit apart (again largely because of carbon isotopes). This is a highly significant result, since if the peaks cannot be resolved, then the charge state of the fragments in question cannot readily be determined, and then masses cannot readily be assigned (since the mass spectrometer determines only mass to charge ratio). Without resolution of these peaks, there will be ambiguity as to whether the daughter ion in question is a triply charged higher mass or a doubly charged lower mass, or a singly charged even lower mass.

With the invention, if the isotope peaks are 0.5 m/z unit apart, then the ion in question is likely to be a doubly charged ion. If the isotope peaks are ⅓ m/z unit apart, then the ion is likely to be triply charged. When the charge state is known, masses can be assigned and the analysis becomes much simplified and far more accurate. It is expected that even higher resolution (i.e. less than ⅓ m/z unit) can be obtained.

It is found with the present invention that not only is the resolution greatly increased, but in addition the sensitivity (i.e. the number of ions per second counted at the detector 26) is generally not seriously degraded and can in fact, in some cases, actually be increased. This contrasts with the normal "trade-off" experience, in which when the resolution is increased, the sensitivity is usually decreased and vice versa.

Reference is next made to FIGS. 13 to 19 inclusive, which show MS/MS spectra of renin substrate m/z 880++ to m/z 640++ and demonstrate the sensitivities achieved with high and low pressure collision cells. In each case the collision energy was optimized for maximum fragment intensity at m/z 640++. In the following discussion, "high resolution" means that Q3 was set to resolve masses at least as close together as ½ m/z unit (as in FIG. 9). "Unit resolution" means that Q3 was set to resolve at least masses 1 m/z apart (as in FIG. 10). The results were as follows.

Figure 13:
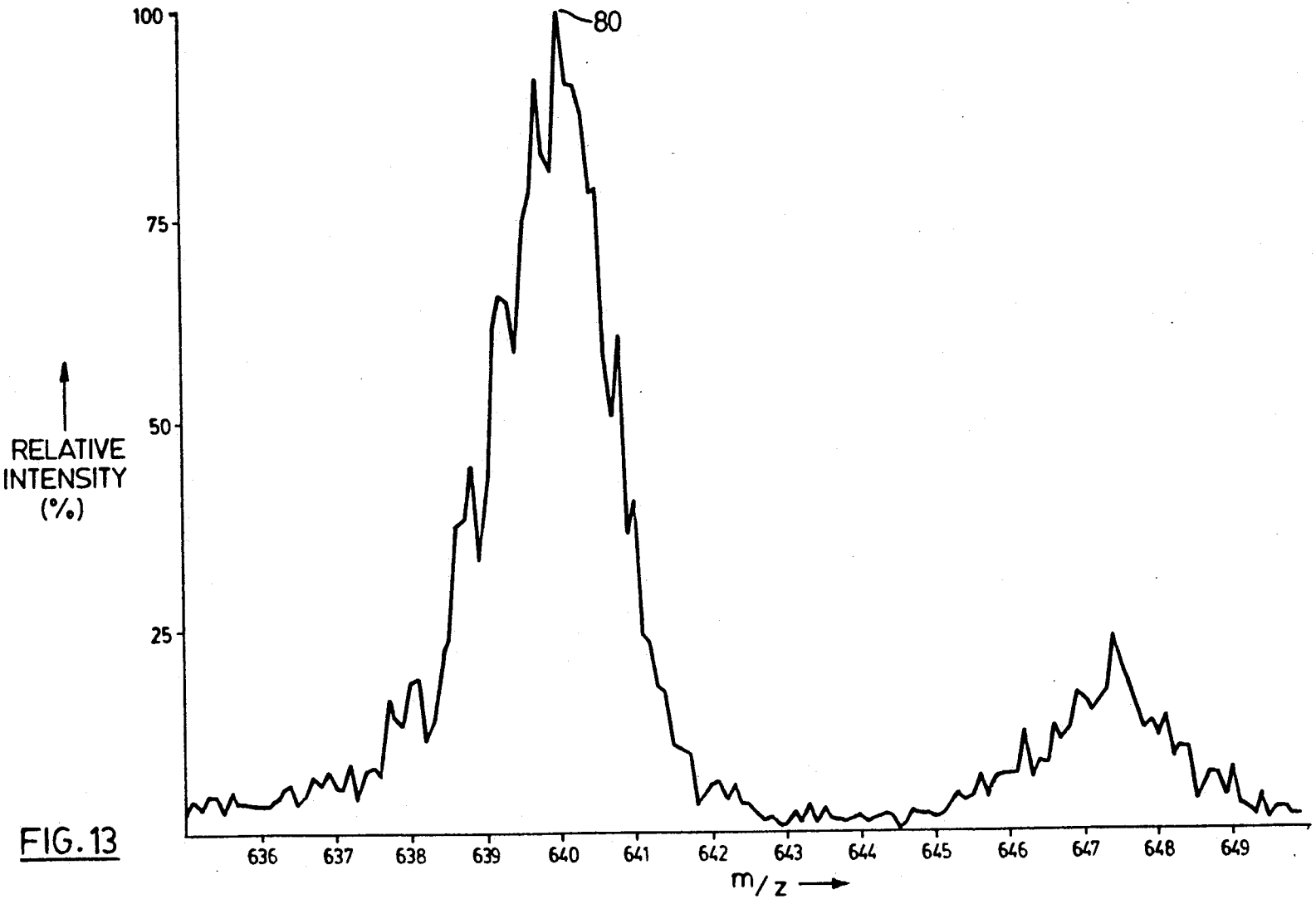

FIG. 13 was made at low pressure ($5\times10^{-4}$ Torr), with the RF to DC ratio the same as that used for FIG. 10, i.e. a ratio which would have given unit resolution had the pressure in Q2 been sufficiently high. The potential difference between RF-only rods 20 and Q2 was 100 volts, resulting in 200eV of collision energy (for doubly charged parent ions). The maximum intensity achieved at peak 80 (for m/z 640++) was $2.3\times10^3$ counts per second. The offset voltage between Q3 and Q2 was zero. The peak was very broad and poorly resolved.

Figure 14:
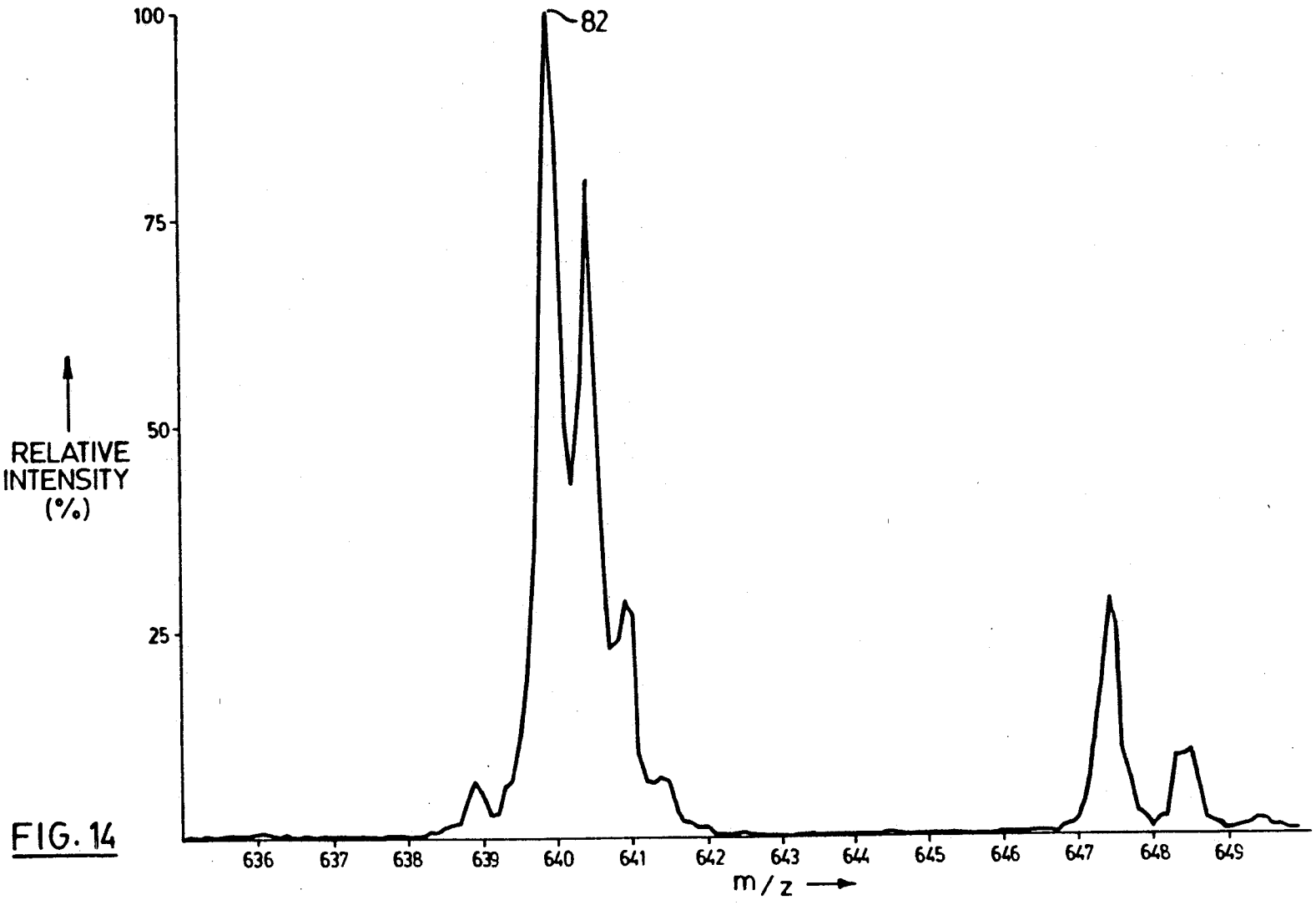

FIG. 14 was made using a higher pressure (5 millitorr), high resolution, and a 40 volt potential difference resulting in 80eV of collision energy. The offset between Q3 and Q2 was minus one volt (Q3 was one volt less than Q2). This resulted in a peak 82 at about m/z 640++ of $17.4\times10^3$ counts per second, i.e. not only was the resolution much higher than for FIG. 13, but in addition the sensitivity was nearly eight times higher.

Figure 15:
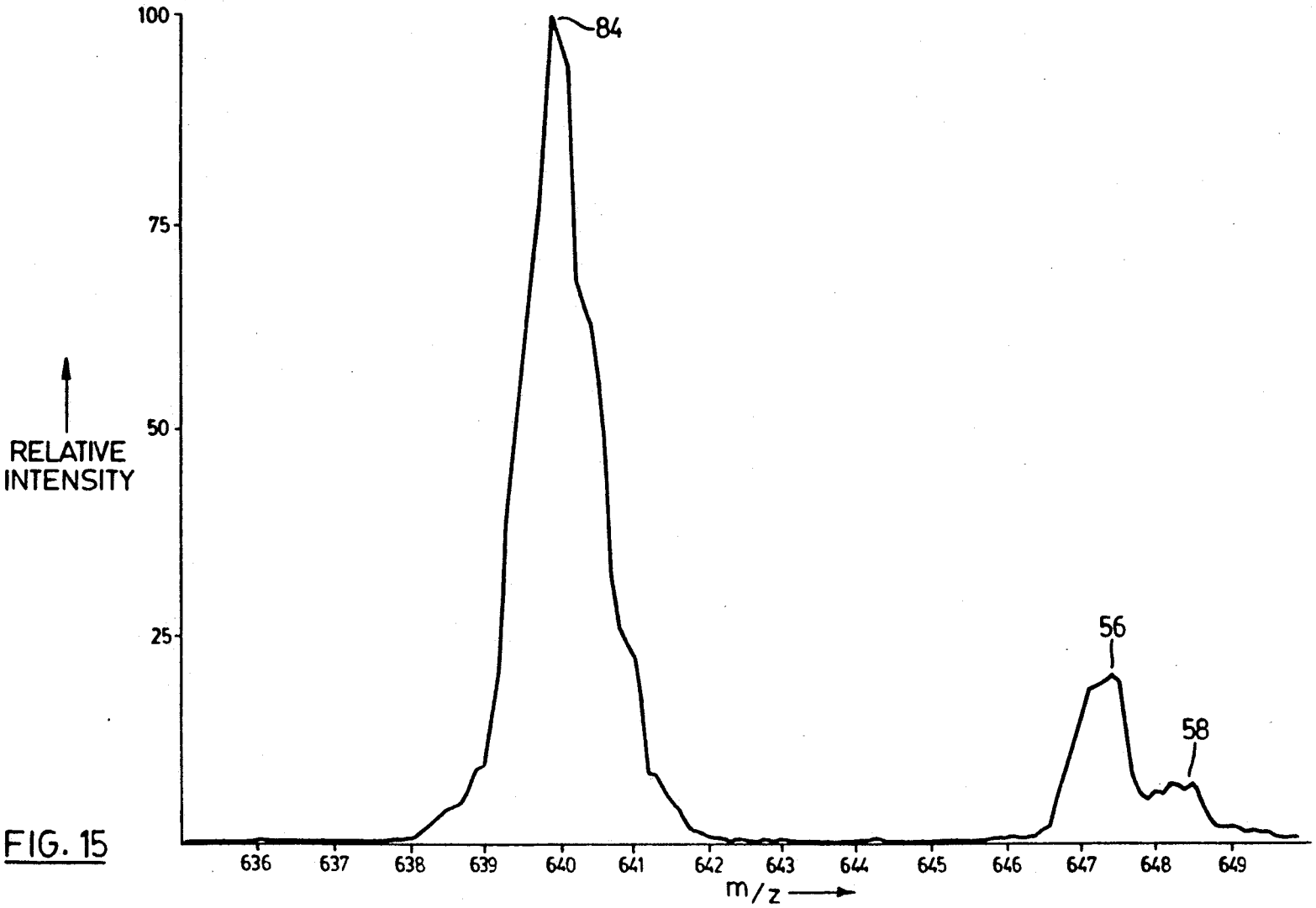

FIG. 15 was made using unit resolution, 5 millitorr in Q2, and a 40 volt potential difference resulting in 80eV collision energy. The offset between Q3 and Q2 was again minus one volt. This produced a peak 84 at m/z 640++ of about $61.6\times10^3$ counts per second, or more than three times that achieved for FIG. 14. However the difference in resolution was clearly visible, although peak 84 was still narrower than peak 80.

Figure 16:
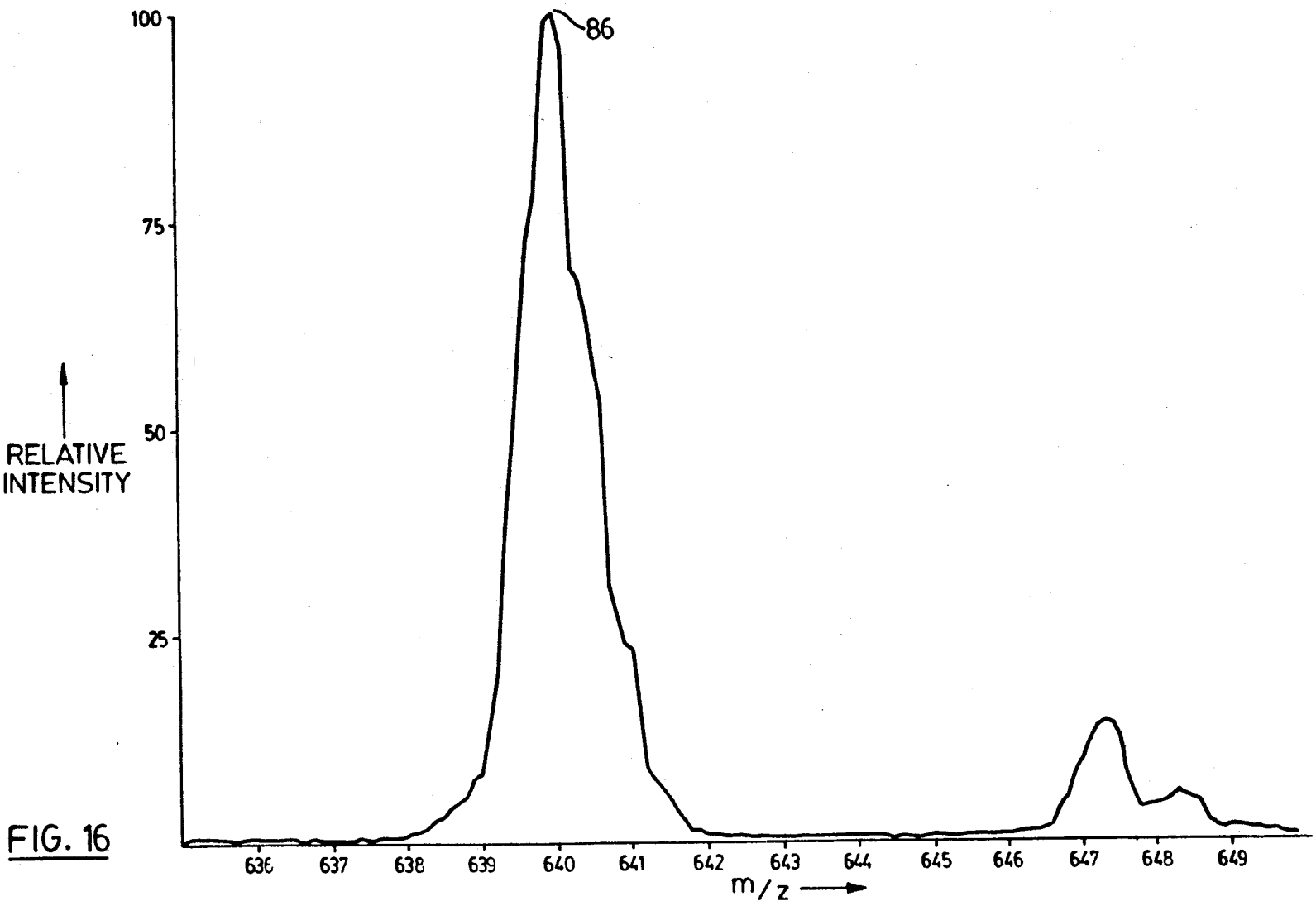

FIG. 16 was made using 7 millitorr in Q2, unit resolution, and a 45 volt potential difference resulting in 90eV collision energy. The offset between Q3 and Q2 was −1 volt. This resulted in a peak 86 for m/z 640++ of $150\times10^3$ counts per second, or more than twice that of FIG. 15, but again with only unit resolution. This was about 150 times better than the API III instrument described previously.

Figure 17:
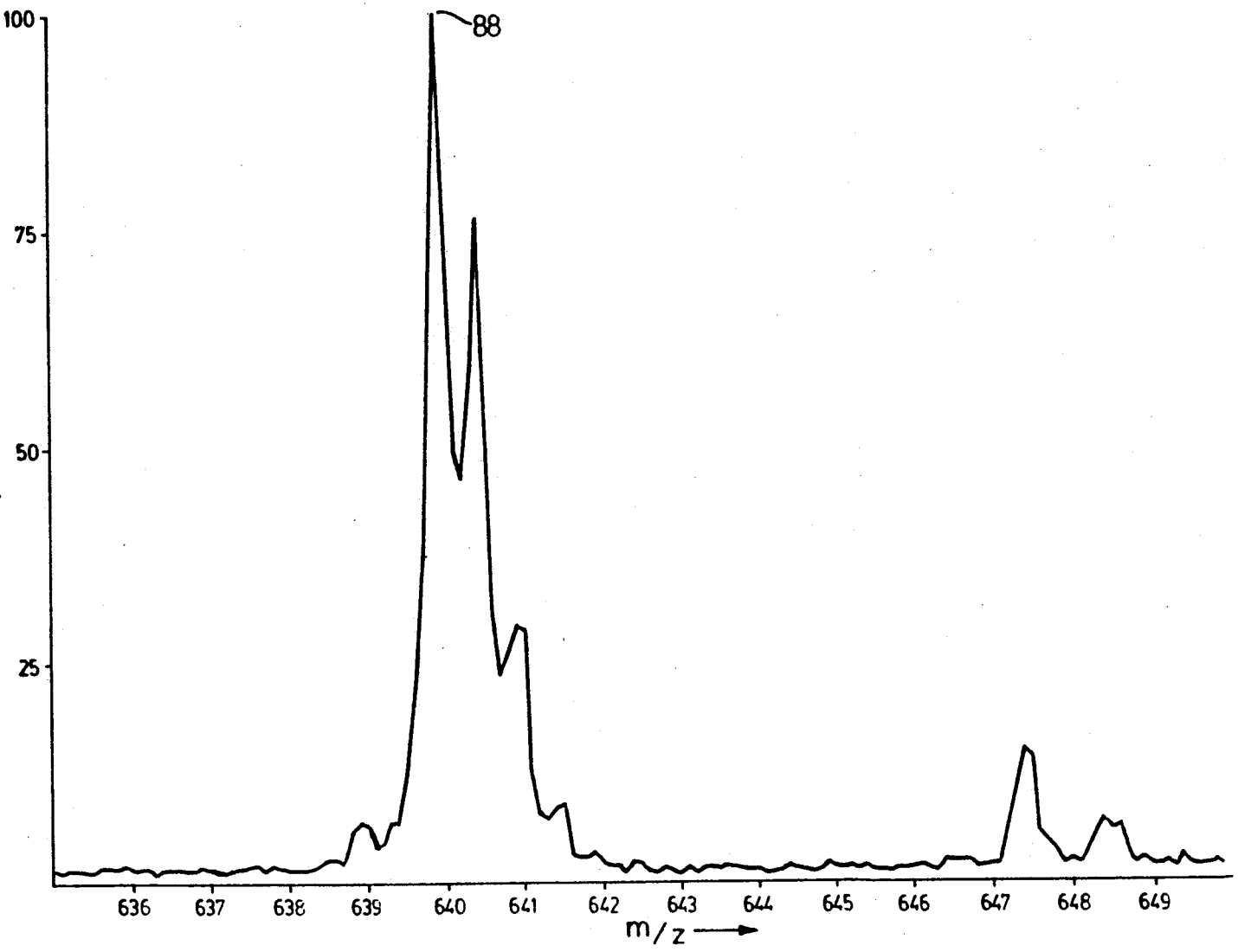

FIG. 17 was made using 7 millitorr in Q2, high resolution setting, and a 45 volt potential difference resulting in 90eV collision energy. The offset between Q3 and Q2 was −1 volt. Here, the sensitivity at peak 88 (for m/z 640++) was $17.2\times10^3$ counts per second, or about the same as that achieved for FIG. 14, with about the same resolution.

Figure 18:
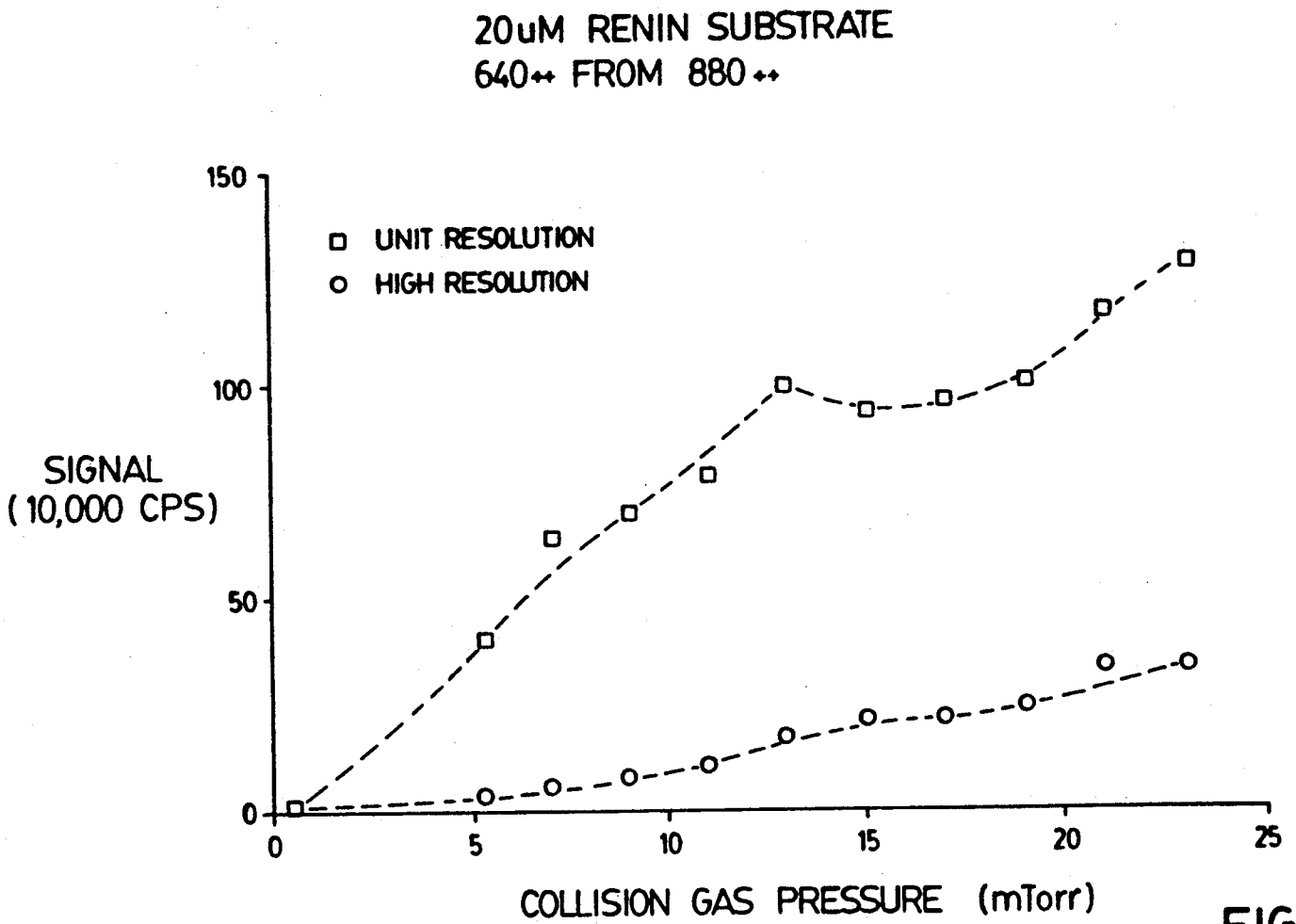
FIG. 18 is a chart showing variation of signal intensity with collision gas pressure.

The increase in sensitivity (i.e. signal) with pressure may vary depending on the substance being analyzed. For renin substrate, doubly charged parent ion m/z 880++, reference is next made to FIG. 18, which shows the variation in sensitivity (for daughter ion m/z 640++) on the vertical axis (in units of 10,000 counts per second) with collision gas pressure in Q2 in millitorr on the horizontal axis. The collision energy at 0.5 millitorr was 200eV, at 5.4 millitorr was 80eV, and at all other observation points was 100eV. FIG. 18 shows two curves, 90 and 92, for unit and high resolutions respectively. It will be seen that in both cases, the sensitivity continues to increase as the pressure is increased up to 23 millitorr. For unit resolution the sensitivity increase from 0.5 to 23 millitorr was about 130 times, and for high resolution the sensitivity increase was about 87 times.

Figure 19A:
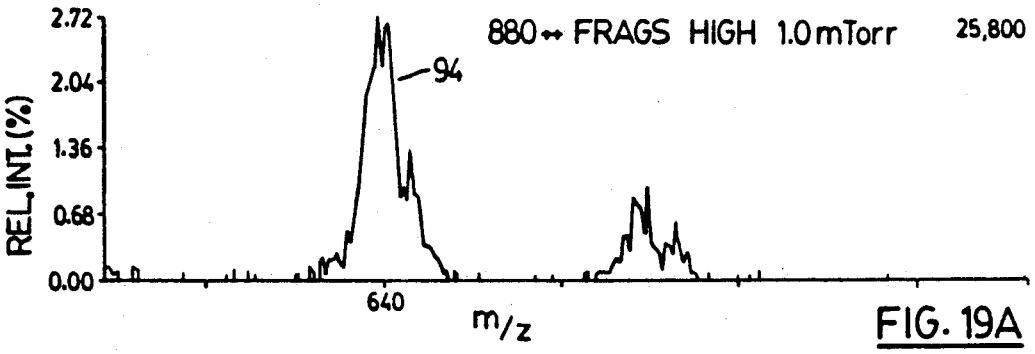
FIG. 19(A–D) show four mass spectra taken at increasing collision gas pressure.
Figure 19B:
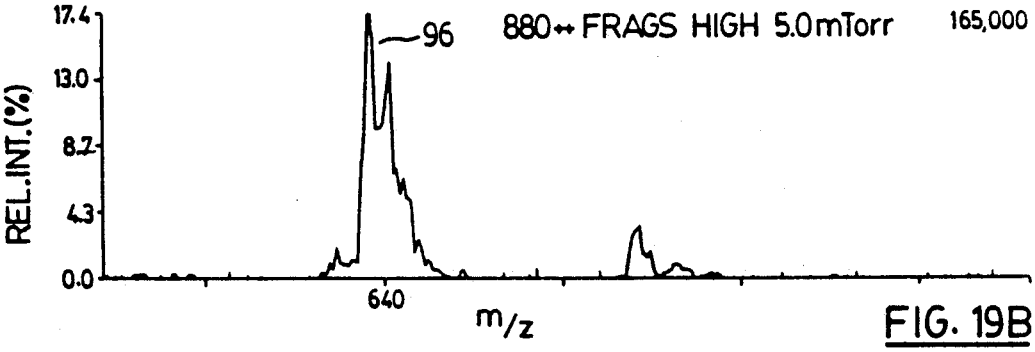
Figure 19C:
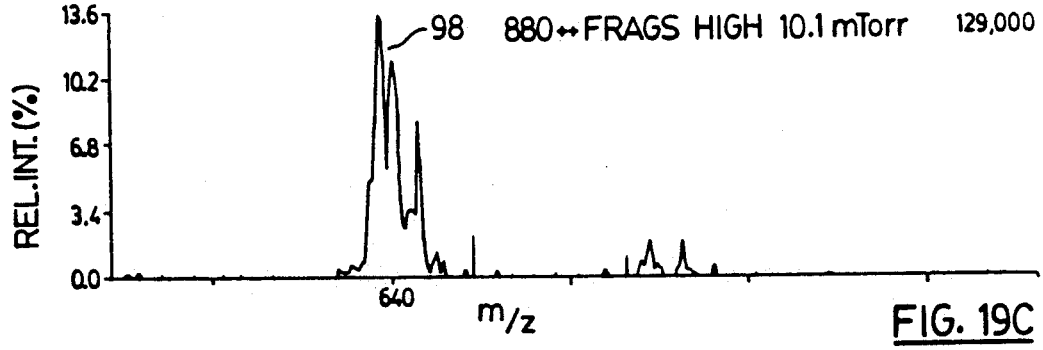
Figure 19D:
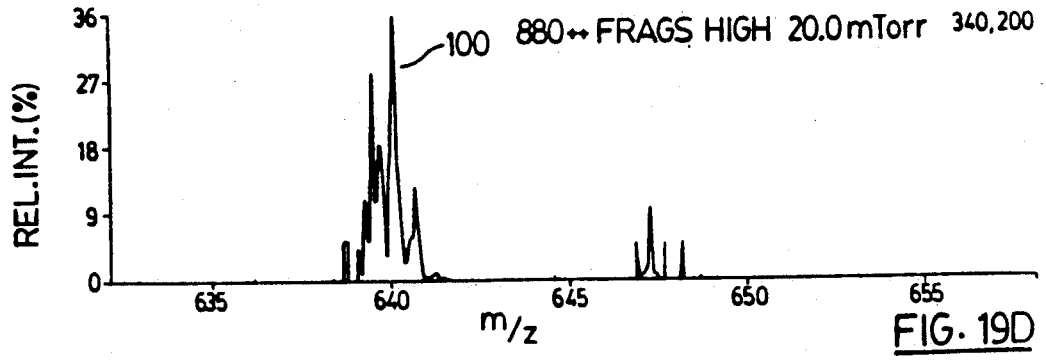

Reference is next made to FIGS. 19A to 19D, which show mass spectra for renin substrate m/z 880++ (doubly charged parent ion) for various pressures and resolutions. These figures were all made with high resolution settings in Q3, and with the DC offset voltage on Q3 set at 0 volts in FIG. 19A and −1 volt in FIGS. 19B to 19D. FIG. 19A shows a mass spectrum made with 1 millitorr in Q2; FIG. 19B shows a mass spectrum made with 5 millitorr in Q2; FIG. 19C shows a mass spectrum made with 10.1 millitorr in Q2, and FIG. 19D shows a mass spectrum made with 20 millitorr in Q2. In all cases the relative intensity (i.e. the size of the peaks displayed as compared with that of the highest peak) is shown on the vertical axis. It will be seen that in FIG. 19A, the peak 94 at about m/z 640 (for doubly charged fragments) was broad and poorly resolved. In FIG. 19B, at 5 millitorr, the resolution improved considerably, as shown by peaks 96. As the pressure increased, peaks 98 and 100 in FIGS. 19C and 19D show that the resolution continued to increase.

A further measure of the effectiveness of the invention is the collision induced dissociation efficiency ("CID efficiency"), and the collection efficiency. The CID efficiency is the ratio: the sum of all daughter ions measured at detector 26, divided by the sum of all parent ions measured at detector 26 with no collision gas present in Q2, with only Q1 resolving but with the voltages in the ion optics set for MS/MS. The CID efficiency is usually quite low. The collection efficiency is the ratio: total ions measured at detector 26 (daughters plus parents), divided by the sum of all parent ions measured at detector 26 with no collision gas present in Q2, with only Q1 resolving but with the voltages on the ion optics set for MS/MS.

Figure 20A:
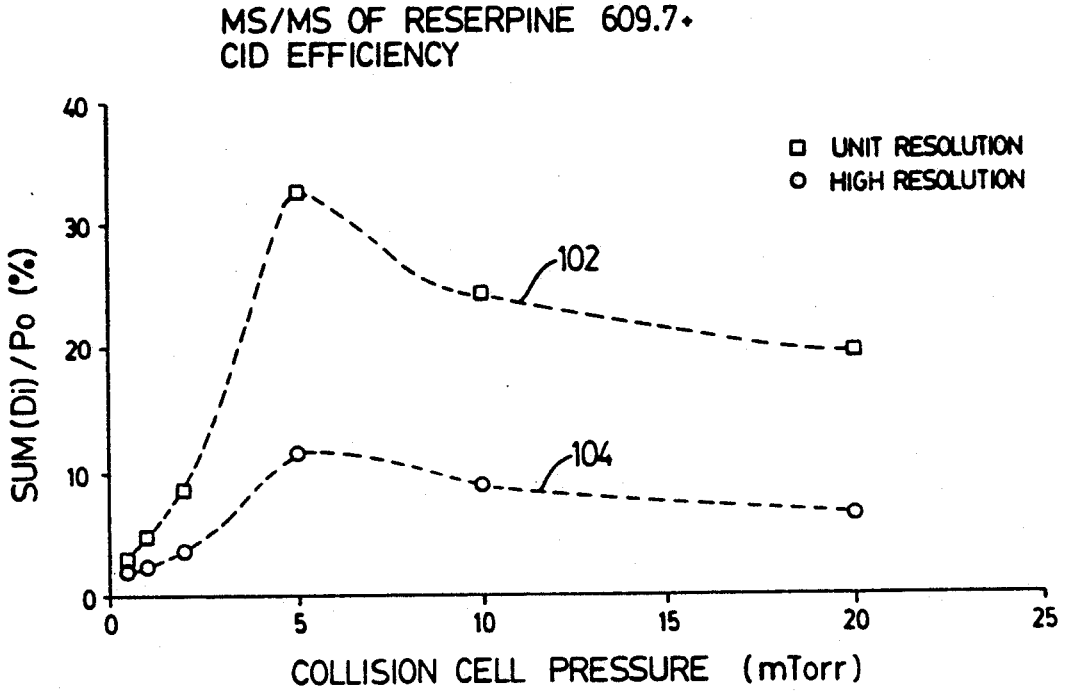
FIGS. 20(A–B) and 21(A–B) are plots showing CID efficiency and collection efficiency plotted against collision gas pressure for two substances.

FIG. 20A shows the CID efficiency for reserpine 609.7+ at unit resolution (curve 102) and high resolution (curve 104). The collision energies ranged from 100eV at 0.5 millitorr to 35eV at 5 millitorr and higher pressures and were selected to optimize the fragment ion signal at about m/z 195. The DC offset voltage on Q3 was 0 volts at $5\times10^{-4}$ torr and $1\times10^{-3}$ torr and was minus 1 volt at all other pressures. It will be seen that at unit resolution the CID efficiency increases (curve 102) until about 5 millitorr is reached, and then decreases gradually. At high resolution (curve 104) a similar result occurs, although at lower levels of CID efficiency.

Figure 20B:
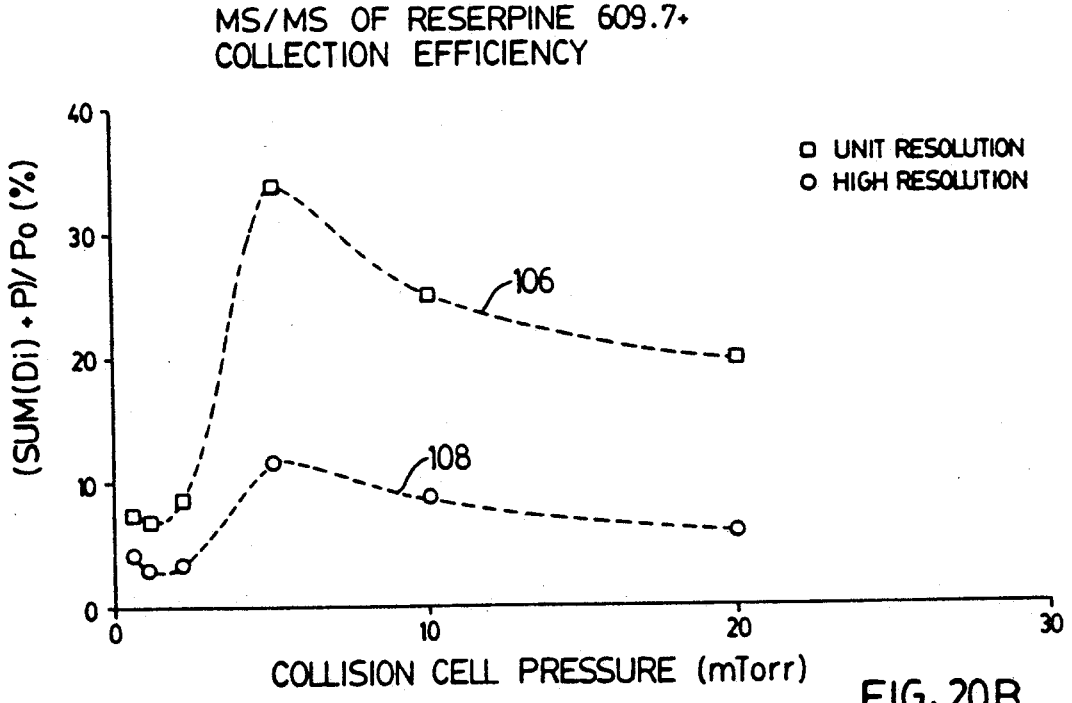

The collection efficiency is shown in FIG. 20B at curve 106 for unit resolution and at curve 108 for high resolution and is similar to the CID efficiency, except that it will be seen that as the pressure increases to about 2 millitorr, the collection efficiency drops and then begins to rise as the pressure continues to increase. The collection efficiency peaks at about 5 millitorr and then drops, but relatively gradually.

Figure 21A:
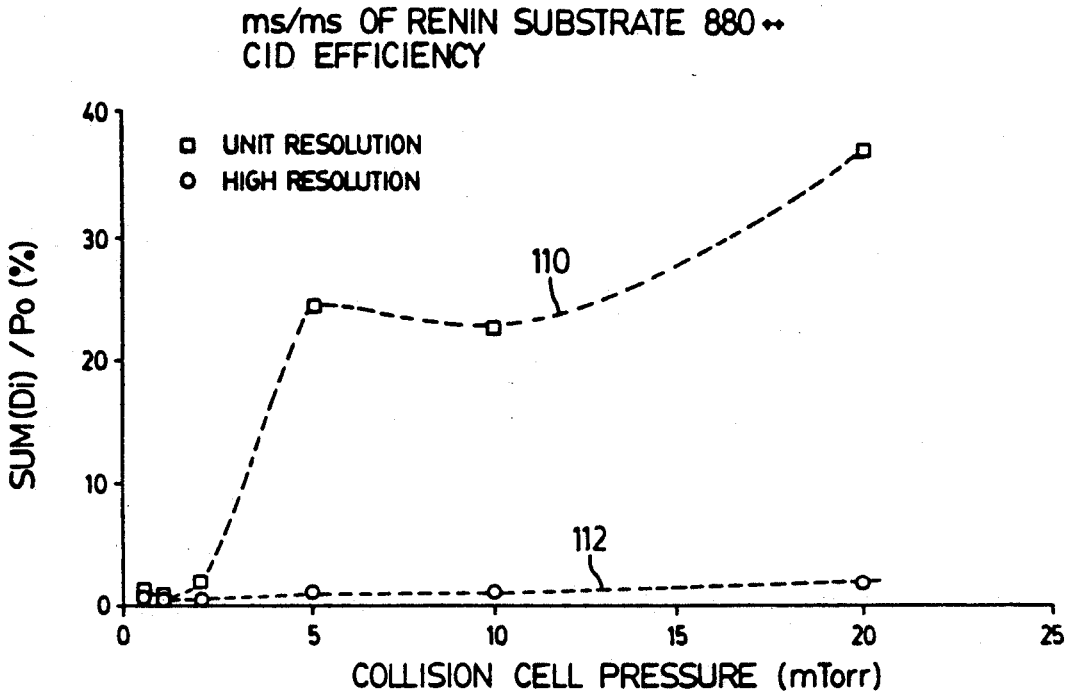
Figure 21B:
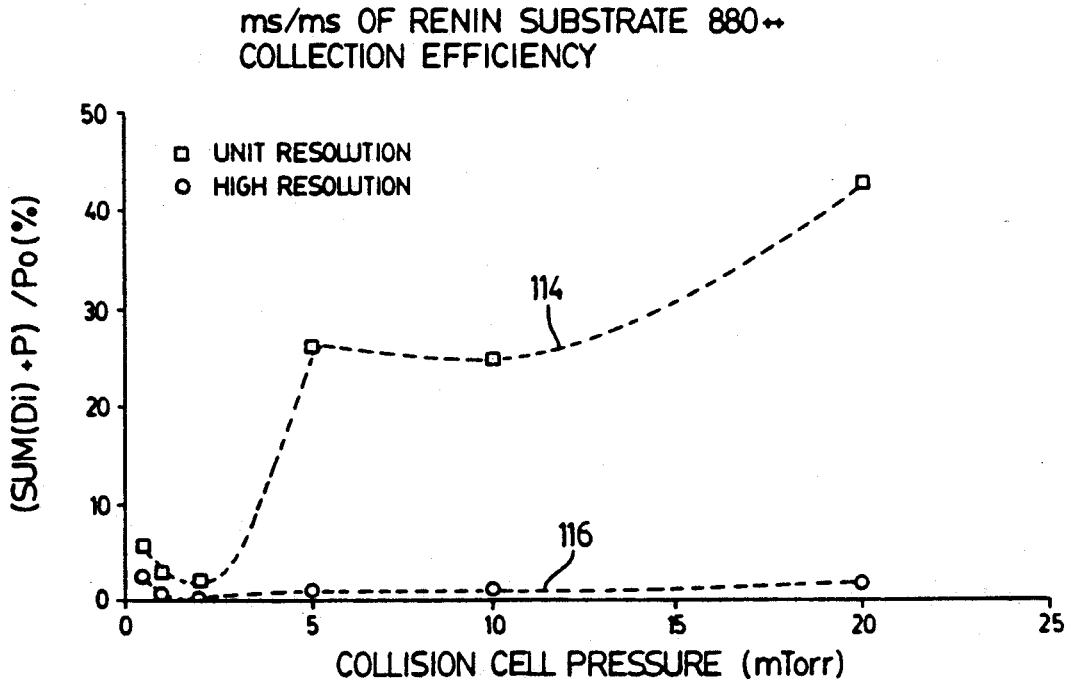

FIGS. 21A and 21B show the same curves as in FIGS. 20A and 20B, but for renin substrate m/z 880++. The collision energies ranged from 200eV at 0.5 millitorr to 70eV at 5 millitorr and higher pressures and were selected to optimize the fragment ion signal at about m/z 640. The DC offset voltage on Q3 was 0 volts at $5\times10^{-4}$ torr and $1\times10^{-3}$ torr and was minus 1 volt at all other pressures. In FIG. 21A it will be seen from curves 110, 112 (unit resolution and high resolution respectively) that the CID efficiency drops slightly as the pressure increases to about 2 millitorr, and then continues to increase as the pressure is increased to 20 millitorr. The same result occurs for collection efficiency, shown by curves 114, 116 in FIG. 21B. This indicates, as shown by the previous results, that the daughter ion yields at high pressure remain relatively high and in some cases may even increase with pressure.

In general, it is believed that the minimum pressure in a 20 cm collision cell for Q2 should be at least 2 millitorr, but at least 5 millitorr is preferred, and at least 7 millitorr can in some cases produce better results. It will be seen that the pressure can be increased to beyond 20 millitorr with good results.

The pressures given above are at about 20° C. It is preferable to express the target thickness S in non temperature dependent terms, i.e. in terms of the number density of the collision gas in the collision cell Q2 multiplied by the length of cell Q2. The relation between pressure and number density is linear (1 millitorr$=3.3\times10^{13}$ molecules (or atoms) $cm^{-3}$, 10 millitorr$=3.3\times10^{14}$ molecules (or atoms) $cm^{-3}$, all at 20° C.).

Therefore, expressed in these terms, the minimum target thickness S should be at least $6.6\times10^{13}\times20$ cm$=1.32\times10^{15}$ $cm^{-2}$ (the term "molecules" or "atoms" in this expression is understood), corresponding to 2 millitorr at 20° C. Preferably the target thickness is at least $3.30\times10^{15}$ $cm^{-2}$ (corresponding to 5 millitorr at 20° C.). It can in some cases be at least $4.62\times10^{15}$ $cm^{-2}$ (7 millitorr at 20° C.), and can go beyond $1.32\times10^{16}$ $cm^{-2}$ (20 millitorr at 20° C.).

As discussed, an important aspect of the invention is that it enables unusually good resolution in Q3, i.e. peaks closely adjacent in m/z can be distinguished from each other. Preferably Q3 is operated to achieve at least unit resolution (in which adjacent peaks 1 amu apart can be distinguished), and more preferably Q3 is operated to achieve better than unit resolution, so that closer peaks (e.g. 0.5 m/z units or 0.33 m/z units apart or even closer) can be distinguished. It is noted that resolution can be defined in terms of the ratio of the height of the valley between the two peaks to be resolved, divided by the height of the smaller peak. If the valley is 100% of the height of the smaller peak, the peaks cannot normally be resolved. If the valley is 90% of the height of the smaller peak, the peaks can usually readily be resolved. Therefore unit resolution (for example) can also be defined as that resolution where the height of the valley between two adjacent peaks 1 m/z unit apart does not exceed about 90% of the height of the smaller peak.

Although the resolution of Q3 will frequently be set to greater than unit resolution, in some cases the resolution may not be as important as high sensitivity. In that case, and as shown in FIGS. 20A and 21A, it will be seen that where Q3 is set to unit resolution, the CID efficiency above pressures of 3 millitorr (target thickness $1.98\times10^{15}$ $cm^{-2}$) is at least about 10%, and increases to more than 20% at pressures above 5 millitorr (target thickness $3.30\times10^{15}$ $cm^{-2}$). These relatively high CID efficiencies have previously been achieved in Q3 at high parent ion masses (e.g. above 200 amu) only at resolutions much worse than unit resolution if at all.

While Q2 has been described as quadrupole collision cell, other multipoles, e.g. hexapoles and octopoles, can be used. Further, other types of mass spectrometers, e.g. a magnetic sector or a high resolution electric and magnetic sector, or an ion trap, can be used instead of quadrupoles Q1 and/or Q3.

Figure 22:
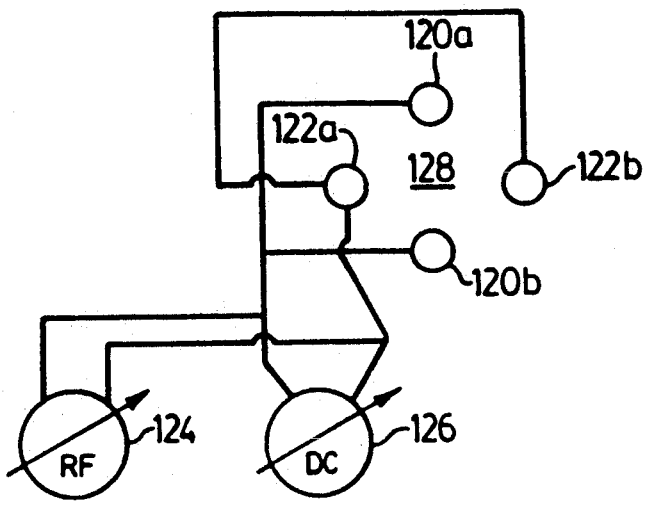
FIG. 22 (PRIOR ART)
FIG. 22 is an end view of a prior art quadrupole rod set showing connections thereto.

Since repeated references have been made to setting the resolution of Q3, a brief discussion of how the resolution is actually set follows, although this is well known in the field. As shown in FIG. 22, a quadrupole has four rods 120*a*, 120*b*, 122*a*, 122*b*. Rods 120*a*, 120*b* are connected to each other, as are rods 122*a*, 122*b*. RF and DC voltages are applied between the pairs of rods from sources 124, 126 respectively.

Figure 23:
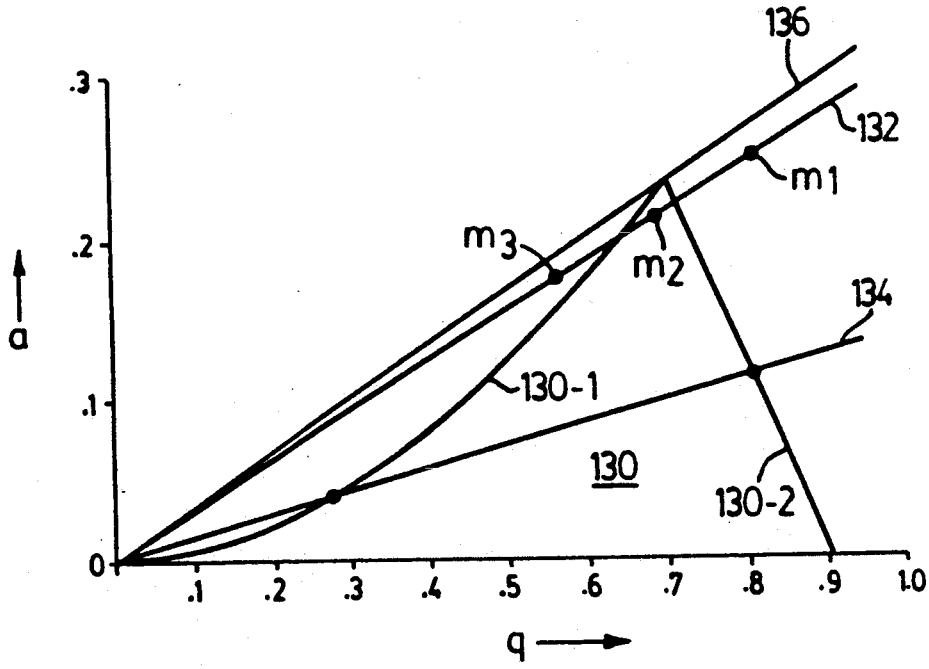
FIG. 23 (PRIOR ART)
FIG. 23 shows the standard stability diagram for a quadrupole mass spectrometer.

As ions move through the space 128 between the rods, they tend to oscillate laterally under the influence of the applied fields. Ions having m/z ratios in a selected range are able to pass through the rods; ions outside this m/z range oscillate out, strike the rods, and do not pass through. The standard stability diagram for quadrupole mass spectrometers is shown in FIG. 23, where "a" and "q" are plotted on the y and x axis respectively. As is well known, $$a = \frac{8eU}{m\Omega^2 r_0^2}$$

and $$q = \frac{4eV}{m\Omega^2 r_0^2}$$

where U is the DC amplitude; V is the RF amplitude; e is the charge on the ion; m is its mass, $\Omega$ is the RF frequency, and $r_0$ is the inscribed radius of the rod set. Ions in the region indicated at 130 (bounded by lines 130-1, 130-2 and the q axis) are stable and will pass through the rod set; other ions are unstable and will not pass through.

A typical scan line is shown at 132 in FIG. 23. Masses $m_1$, $m_2$ and $m_3$ represent ions of increasing mass. Only ion $m_2$ is in the stable region 130 so only this ion will be detected.

Two further scan lines 134, 136 are shown in FIG. 23. It will be seen that since scan line 134 has a substantial length inside the stable region 130, ions of a wide range of masses will be transmitted on this scan line, and the resolution will be poor (but the ion signal transmitted will be relatively high). For scan line 132, the resolution will be better, since a much smaller range of masses is transmitted. For scan line 136, which intersects the stability region at its tip, only a very narrow range of masses will be transmitted, so the resolution will be high. However normally the ion signal intensity would be very low.

Since $\Omega$ and $r_0$ are fixed, a desired scan line, i.e. a desired resolution, can be chosen simply by setting the required values for the RF and DC voltage amplitudes U and V. As discussed, for high resolution (better than one amu), a scan line near the peak of the stable region 130 is selected. With the invention, this results usually in better high resolution and relatively high ion intensity. Alternatively, the CID efficiency can be selected by selecting a scan line which creates the desired efficiency at a given target thickness. With the invention, it is usually possible to have a relatively high CID efficiency (e.g. 10%) and still have relatively good resolution, depending on the pressure (target thickness) selected, yet without ramping the offset voltage on Q3. Normally, the offset voltage on Q3 will be fixed, or substantially fixed, for at least a substantial part (e.g. ½ or more) of the spectrum, preferably the entire spectrum, and will normally be of relatively low value. Usually it will not exceed about 5 volts DC in absolute value.

It is also noted that without ramping the offset voltage on Q3, the same resolution can nevertheless be achieved for higher mass peaks as for lower mass peaks, for daughter ions having the same charge. In other words, the peak widths (in m/z units), measured at the same fraction of the peak height, are substantially the same for all masses of daughter ions having the same charge.

Figure 24:
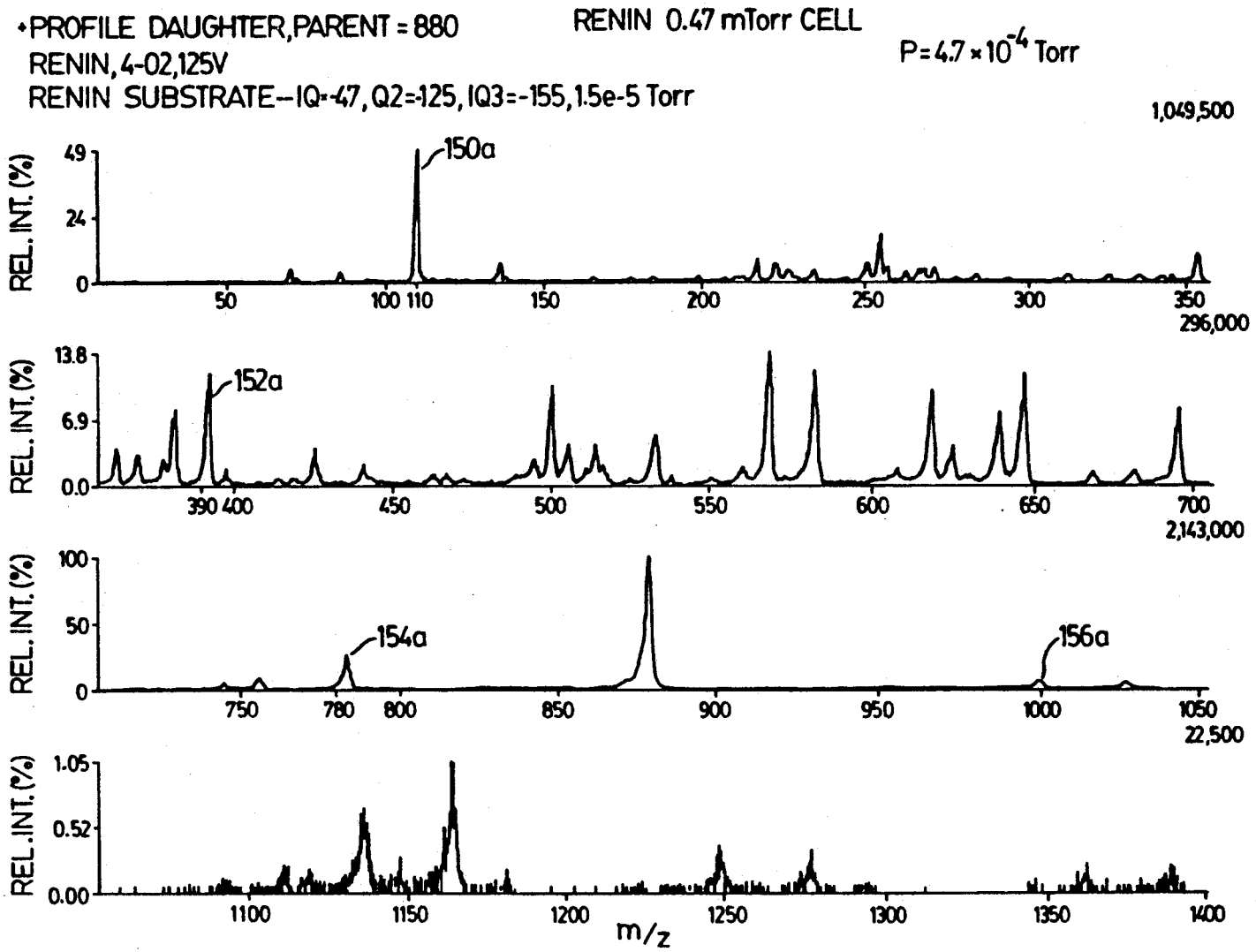
FIG. 24 is a mass spectrum made at relatively low pressure in quadrupole Q2.
Figure 25:
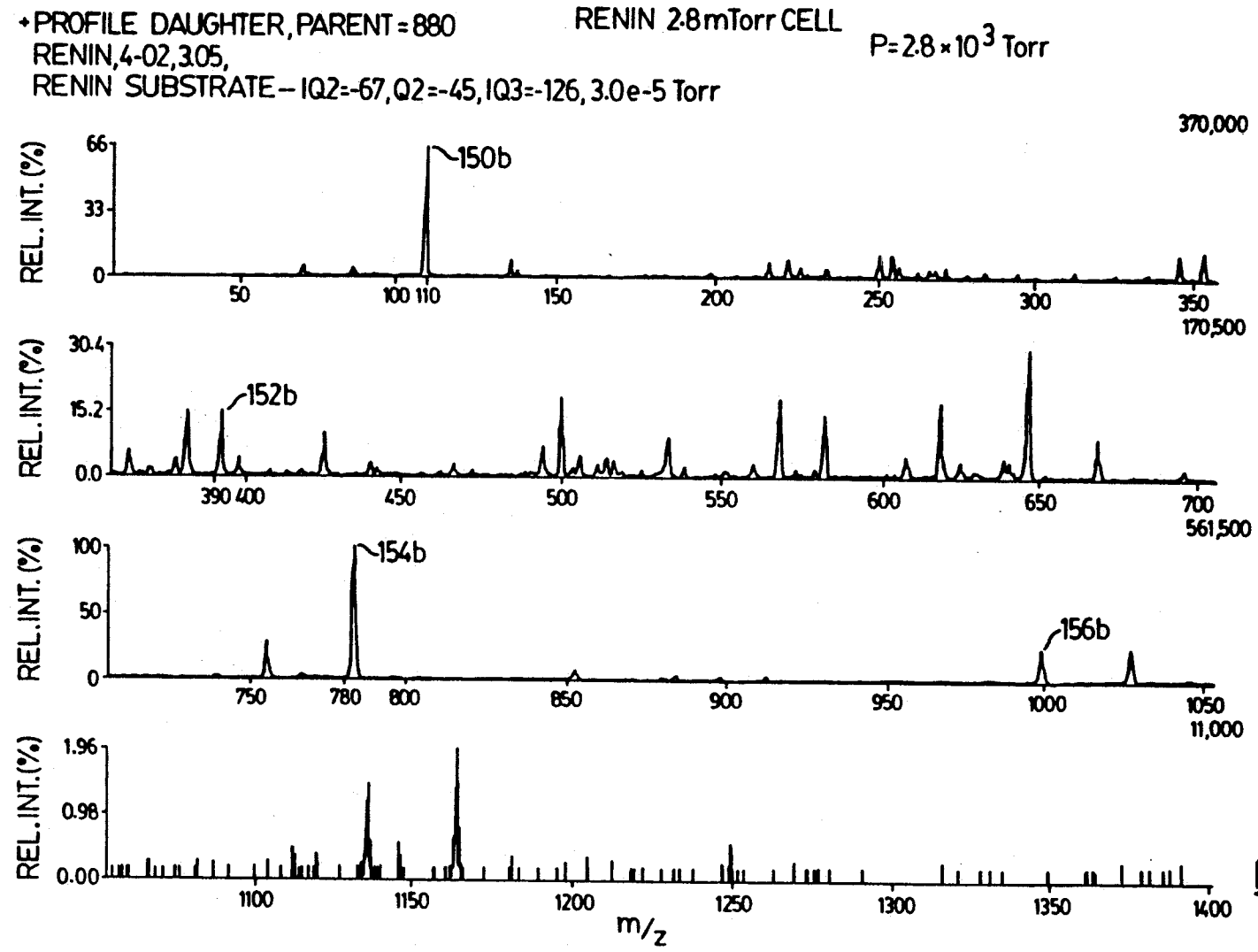
FIG. 25 is a mass spectrum made at higher pressure in quadrupole Q2.
Figure 26:
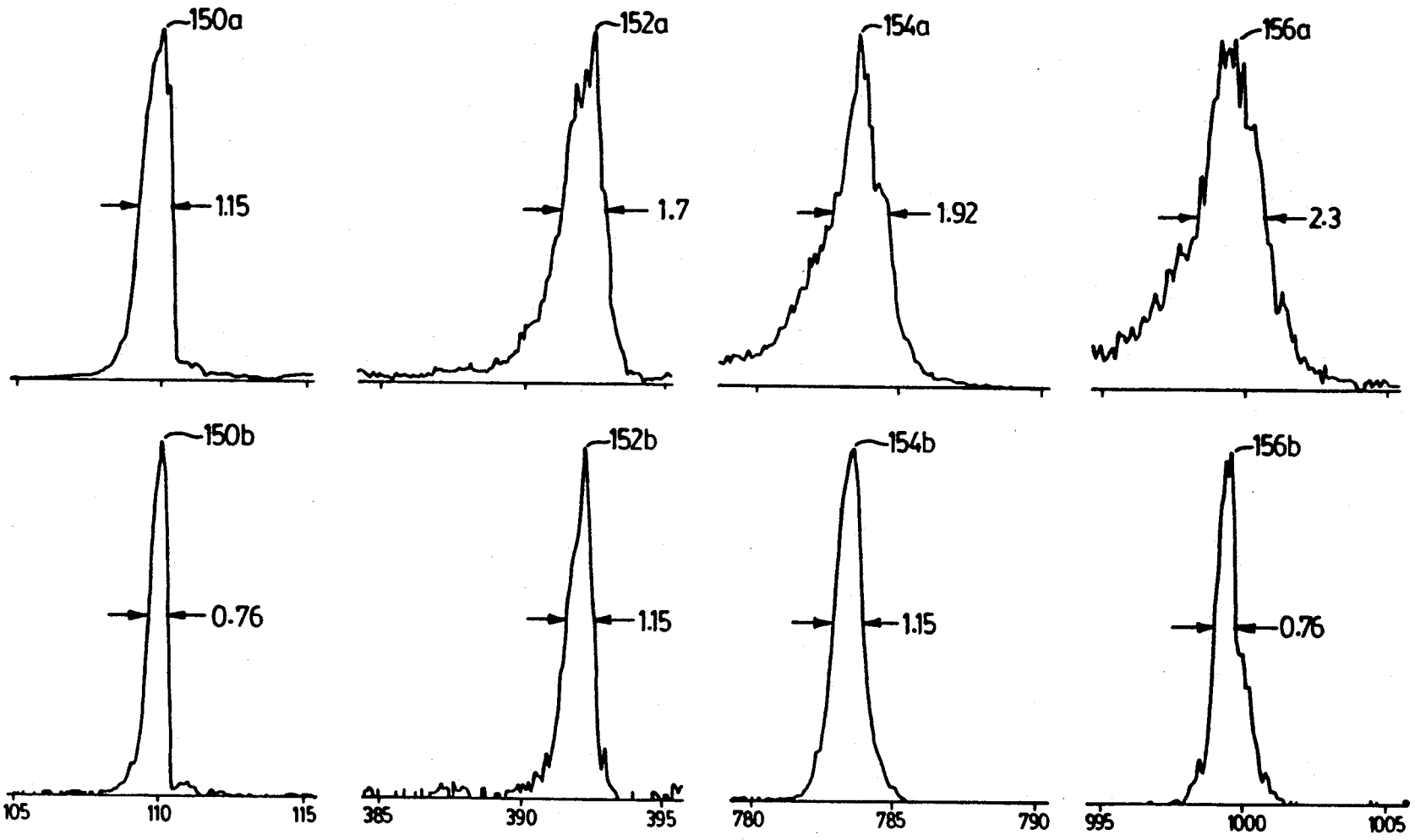
FIG. 26 shows the widths of selected peaks from FIGS. 24 and 25.

By way of example, reference is made to FIGS. 24 to 26. FIGS. 24 and 25 show mass spectra from m/z 10 to 1,400 for renin substrate m/z 880++ parent ion. For FIG. 24, the pressure in Q2 was 0.47 millitorr, while for FIG. 25, the pressure in Q2 was 2.8 millitorr. For FIG. 24, the DC offset voltage on Q3 was 0 volts, while for FIG. 25, it was −0.5 volts.

It will be seen in FIG. 24 that the peak widths are relatively narrow in the lower mass part of the range but become broader in the higher mass part of the spectrum. It will be seen that in FIG. 25, the peaks appear to be more constant in width throughout the entire spectrum. This is illustrated in more detail in FIG. 26, in which the following peaks from FIGS. 24 and 25 are shown enlarged: peaks 150*a*, 150*b* at about m/z 110; peaks 152*a*, 152*b* at about m/z 392; peaks 154*a*, 154*b* at about m/z 783; and peaks 156*a*, 156*b* at about m/z 999. All the peaks are normalized to the same height in FIG. 26, and the width of each peak (in m/z units) at half its height is marked on the drawing. The widths of peaks 150*a* to 156*a* vary from about 1.15 m/z units (at about m/z 110) to about 2.3 m/z units (at about m/z 999), i.e. the width increases with mass and the variation in widths is about 1.15 m/z units. The widths of peaks 150*b* to 156*b* vary by only about 0.39 m/z units; this variation was evidently largely because of slight nonlinearities in the quadrupole power supply. The widths of the peaks 150*b* to 156*b* do not increase with increasing m/z. In general, the variations in width tend to decrease as the pressure in Q2 increases above about 2.8 to 3 millitorr. It is considered that a variation in width of about ±0.25 m/z units on each side of the centre of the peak (total variation in width 0.5 m/z units) is for most practical purposes a substantially constant peak width. It is expected that with a more linear quadrupole power supply, the peak widths would be constant to within ±0.1 m/z units.

While preferred embodiments of the invention have been described, it will be realized that various changes can be made within the scope of the appended claims.

We claim:

1. In a method of analyzing ions, in which parent ions are directed into a collision cell containing a target gas and collide in said collision cell with said target gas to produce daughter ions from said parent ions, and in which said daughter ions are then directed into an analyzing mass spectrometer and analyzed by producing a mass spectrum thereof, and in which there is a DC circuit between said collision cell and said analyzing mass spectrometer, the improvement comprising maintaining the target thickness of said target gas in said collision cell at least at substantially $1.32\times10^{15}$ cm$^{-2}$, maintaining a substantially constant DC voltage across said DC circuit during the production of at least a substantial portion of said mass spectrum, operating said analyzing mass spectrometer at a resolution at least equal to one m/z unit throughout said substantial portion of said mass spectrum, and producing said mass spectrum having a resolution of at least one m/z unit in at least said substantial portion.

2. The method according to claim 1 wherein the target thickness of said target gas in said collision cell is at least substantially $1.98\times10^{15}$ cm$^{-2}$.

3. The method according to claim 1 wherein the target thickness of said target gas in said collision cell is at least substantially $3.30\times10^{15}$ cm$^{-2}$.

4. The method according to claim 1 wherein the target thickness of said target gas in said collision cell is at least substantially $4.62\times10^{15}$ cm$^{-2}$.

5. The method according to claim 1 and including the steps of directing said parent ions, before they enter said collision cell, through a first mass spectrometer and operating said first mass spectrometer as a mass filter for only parent ions in a selected mass to charge range to be transmitted into said collision cell.

6. The method according to any of claims 1 to 5 and including the step of operating said analyzing mass spectrometer to produce said mass spectrum with a resolution of at least ½ m/z unit in at least said substantial portion of said spectrum.

7. The method according to any of claims 1 to 5 and including the step of operating said analyzing mass spectrometer to produce said mass spectrum with a resolution of at least ⅓ m/z unit in at least said substantial portion.

8. The method according to any of claims 1 to 5 and including the steps of operating said analyzing mass spectrometer with a resolution of at least ½ m/z unit, and producing a mass spectrum which in at least said substantial portion displays and resolves isotopes of at least one doubly charged daughter ion.

9. The method according to any of claims 1 to 5 and including the steps of operating said analyzing mass spectrometer with a resolution of at least ⅓ m/z unit throughout said substantial portion of said spectrum, and producing a mass spectrum which displays and resolves isotopes of at least one triply charged daughter ion.

10. The method according to any of claims 1 to 5 wherein at least a substantial number of said parent ions have masses greater than 200 atomic mass units.

11. The method according to any of claims 1 to 5 wherein at least a substantial number of said parent ions have masses greater than 400 atomic mass units.

12. The method according to any of claims 1 to 5 in which said DC voltage does not exceed about 5 volts.

13. In a method of analyzing ions, in which parent ions are directed into a collision cell containing a target gas and collide in said collision cell with said target gas to produce daughter ions from said parent ions, and in which said daughter ions are then directed into an analyzing mass spectrometer and analyzed by producing a mass spectrum thereof, the improvement comprising maintaining the target thickness of said target gas in said collision cell at least at substantially $3.30\times10^{15}$ cm$^{-2}$, operating said analyzing mass spectrometer at a resolution at least equal to unit resolution throughout at least a substantial portion of said mass spectrum, and producing said mass spectrum having a resolution of at least one m/z unit.

14. The method according to claim 13 wherein the target thickness of said target gas in said collision cell is at least substantially $4.62\times10^{15}$ cm$^{-2}$.

15. The method according to claim 13 wherein at least a substantial number of said parent ions have masses greater than 200 atomic mass units.

16. The method according to claim 13 wherein at least a substantial number of said parent ions have masses greater than 400 atomic mass units.

17. The method according to claim 13, 14, 15 or 16 wherein there is a DC circuit between said collision cell and said analyzing mass spectrometer, said method including the step of maintaining a substantially constant DC voltage across said DC circuit during the production of said substantial portion of said mass spectrum.

18. The method according to claim 13 and including the steps of directing said parent ions, before they enter said collision cell, through a first mass spectrometer and operating said first mass spectrometer as a mass filter for only parent ions in a selected mass to charge range to be transmitted into said collision cell.

19. The method according to claim 18 wherein substantially all said parent ions have a mass greater than 200 atomic mass units.

20. The method according to claim 18 wherein substantially all said parent ions have a mass greater than 400 atomic mass units.

21. The method according to any of claims 13, 14, 15 or 16 wherein there is a DC circuit between said collision cell and said analyzing mass spectrometer, and including the step of maintaining a substantially constant DC voltage across said DC circuit during the production of at least said substantial portion of said mass spectrum, said DC voltage being not greater than about 5 volts.

22. In a method of analyzing ions, in which parent ions are directed into a collision cell containing a target gas and collide in said collision cell with said target gas to produce daughter ions from said parent ions, and in which said daughter ions are then directed into an analyzing mass spectrometer and analyzed by producing a mass spectrum thereof, the improvement comprising maintaining the target thickness of said target gas in said collision cell at least at substantially $1.98\times10^{15}$ cm$^{-2}$, operating said analyzing mass spectrometer with a CID efficiency of at least 10 percent, and producing a said mass spectrum having peaks which are of a substantially constant peak width over at least a substantial portion of said mass spectrum.

23. The method according to claim 22 and including the step of maintaining the target thickness of said target gas in said collision cell at least at substantially $3.30\times10^{15}$ cm$^{-2}$.

24. The method according to claim 22 and including the step of maintaining the target thickness of said target gas in said collision cell at least at substantially $4.62\times10^{15}$ cm$^{-2}$.

25. The method according to claim 22 wherein at least a substantial portion of said parent ions have masses at least as great as 200 atomic mass units.

26. The method according to claim 22 wherein at least a substantial portion of said parent ions have masses at least as great as 400 atomic mass units.

27. The method according to any of claims 22 to 26 and in which there is a DC circuit between said collision cell and said analyzing mass spectrometer, and including the step of maintaining a substantially constant DC voltage across said DC circuit during the production of at least said substantial portion of said mass spectrum.

28. The method according to any of claims 22 to 26 wherein said peak widths are constant to within ±0.25 m/z units.

29. The method according to any of claims 22 to 26 wherein said peak widths are constant to within ±0.1 m/z units.

30. In a method of analyzing ions, in which parent ions are directed into a collision cell containing a target gas and collide in said collision cell with said target gas to produce daughter ions from said parent ions, and in which said daughter ions are then directed into an analyzing mass spectrometer and analyzed by producing a mass spectrum thereof, the improvement comprising maintaining the target thickness of said target gas in said collision cell at a pressure sufficient to enable resolution of isotopes of at least one doubly charged daughter ion, and operating said analyzing mass spectrometer with a resolution of at least ½ m/z unit over at least a substantial portion of said spectrum, and producing a mass spectrum which displays and resolves isotopes of said at least one doubly charged daughter ion.

31. The method according to claim 30 wherein said resolution is at least ⅓ m/z unit and said mass spectrum displays and resolves isotopes of at least one triply charged daughter ion.

32. The method according to claim 30 or 31 and in which there is a DC circuit between said collision cell and said analyzing mass spectrometer, and including the step of maintaining a substantially constant DC voltage across said DC circuit during production of at least said substantial portion.

33. The method according to claim 30 or 31 wherein at least a substantial portion of said parent ions have masses at least equal to 200 atomic mass units.

34. The method according to claim 30 or 31 wherein at least a substantial portion of said parent ions have masses at least equal to 400 atomic mass units.

35. The method according to claim 30 or 31 and in which there is a DC circuit between said collision cell and said analyzing mass spectrometer, and including the step of maintaining a substantially constant DC voltage across said DC circuit during production of at least a substantial portion of said mass spectrum, said DC voltage being not greater than about 5 volts, and in which substantially all said parent ions have masses greater than 200 atomic mass units.

36. The method according to claim 30 or 31 and in which there is a DC circuit between said collision cell and said analyzing mass spectrometer, and including the step of maintaining a substantially constant DC voltage across said DC circuit during production of at least a substantial portion of said mass spectrum, said DC voltage being not greater than about 5 volts, and in which substantially all said parent ions have masses greater than 400 atomic mass units.

* * * * *